United States Patent [19]

Uchiyama et al.

[11] Patent Number: 4,788,896

[45] Date of Patent: Dec. 6, 1988

[54] TONE GENERATOR HAVING A VARIABLE NUMBER OF CHANNELS WITH A VARIABLE NUMBER OF OPERATING UNITS

[75] Inventors: Yasuji Uchiyama; Shigeru Suzuki, both of Hamamatsu, Japan

[73] Assignee: Nippon Gakki Seizo Kabushiki Kaisha, Hamamatsu, Japan

[21] Appl. No.: 875,479

[22] Filed: Jun. 18, 1986

[30] Foreign Application Priority Data

Jun. 21, 1985 [JP] Japan ..... 60-135793

[51] Int. Cl.[4] ..... G10H 1/06; G10H 7/00

[52] U.S. Cl. ..... 84/1.01; 84/1.03; 84/1.19; 84/1.24; 340/365 S

[58] Field of Search ..... 84/1.01, 1.03, 1.19, 84/1.24, DIG. 12, DIG. 22; 340/365 S

[56] References Cited

U.S. PATENT DOCUMENTS 3,882,751 5/1975 Tomisawa et al. ..... 84/1.01
4,018,121 4/1977 Chowning ..... 84/1.01
4,543,869 10/1985 Kawashima et al. ..... 84/1.01

FOREIGN PATENT DOCUMENTS 29519 6/1983 Japan .

*Primary Examiner*—Stanley J. Witkowski
*Attorney, Agent, or Firm*—Spensley Horn Jubas & Lubitz

[57] ABSTRACT

A tone generator includes a plurality of tone generation channels each comprising one or more operation channels. One operation channel performs basic operation of a tone signal computing operation (e.g., FM or AM) and a tone signal is generated by using one or more operation channels for one tone generation channel. Tone generation channels in the tone generator are established according to a selected performance mode. In a first mode, the operation channels are divided into N groups and N tone generation channels are established in correspondence to the respective operation channel groups. In a second mode, the operation channels are divided into M groups and M tone generation channels are established in correspondence to the respective operation channel groups wherein N is a different number from M. Tone generation channels of the number required according to the selected performance mode can be established by efficiently utilizing the operation channels of a limited number.

10 Claims, 9 Drawing Sheets

| NORMAL MODE | | | ABC MODE | | |
|---|---|---|---|---|---|
| TONE GENERATION CHANNEL | OPERATION CHANNEL | TONE | TONE GENERATION CHANNEL | OPERATION CHANNEL | TONE |
| CH 1 | 1, 9, 17, 25 | MELODY | CH 1 | 1, 9, 17, 25 | MELODY |
| CH 2 | 2, 10, 18, 26 | | CH 2 | 2, 10, 18, 26 | |
| CH 3 | 3, 11, 19, 27 | | CH 3 | 3, 11, 19, 27 | |
| CH 4 | 4, 12, 20, 28 | | CH 4 | 4, 12, 20, 28 | |
| CH 5 | 5, 13, 21, 29 | | CH 5 | 5, 13, 21, 29 | |
| CH 6 | 6, 14, 22, 30 | | CH 6 | 6, 14, 22, 30 | BASS |
| CH 7 | 7, 15, 23, 31 | | CH 7 | 7, 23 | CHORD |
| | | | CH 8 | 8, 24 | |
| CH 8 | 8, 16, 24, 32 | | CH 9 | 15, 31 | |
| | | | CH 10 | 16, 32 | |

RAM 16

TONE GENERATOR HAVING A VARIABLE NUMBER OF CHANNELS WITH A VARIABLE NUMBER OF OPERATING UNITS

BACKGROUND OF THE INVENTION

This invention relates to a tone signal generation device and, more particularly, to a device capable of generating a tone signal of a desired tone color by performing a tone generating operation (computation) such as a frequency modulation operation and amplitude modulation operation. More particularly, the invention relates to a tone signal generation device in which a plurality of tone generation channels are provided for enabling simultaneous sounding of plural tones and which is capable of changing the maximum number of tones simultaneously produced depending upon a tone or tones to be produced.

A basic system for generating a tone signal by using a frequency modulation (hereinafter abbreviated as FM) operation in the audio frequency range is disclosed in the U.S. Pat. No. 4,018,121. A basic system for generating a tone signal by using an amplitude modulation (hereinafter abbreviated as AM) operation in the audio range is disclosed in Japanese Patent Publication No. 29519/1983. Known also in the art is an electronic musical instrument which includes a limited number of tone generation channels wherein the sounding of a tone for a depressed key is assigned to any of the tone generation channels whereby different tones corresponding in number to the number of the tone generation channels can be simultaneously produced (e.g., the U.S. Pat. No. 3,882,751).

It is also known to employ one of the above described basic operation systems (FM or AM) as a tone generation system in each of such a plurality of tone generation channels and to sound plural tones generated by such operation systems simultaneously. In such prior art electronic musical instruments, the number of tone generation channels is fixed and it is not possible to change this number depending upon the situation.

In a tone generation system employing the above described operation systems, one or more basic operation units (or operation channels) are used in one tone generation channel and operation parameters in each operation unit are suitably selected to generate a tone signal of a desired tone color. In this case, the more the operation units are used, the more various and complex tone color control one can realize. Therefore, the number of basic operation units per one tone generation channel should preferably be large if the tone color or quality of a tone to be achieved is important. Further, there is a case in which a sufficient number of basic operation units are required depending upon the tone color or performance mode selected. On the other hand, there is also a case in which the number of the operation units per one tone generation channel need not be large whereas the number of tones which can be sounded simultaneously should be large. For satisfying the former requirement, the number of the operation units (operation channels) per one tone generation channel must be sufficiently large whereas for satisfying the latter requirement, the number of the tone generation channels must be large. Therefore, there arises the problem that it requires a large and costly device to satisfy both these requirements. Although a plurality of operation units can be realized by using a single basic operation circuit on a time shared basis, the increase in the number of operation units obliges an increase in the time division clock rate which result in a rise in the manufacturing cost. Further, aside from such problems, many unused operation units (operation channels) will be wasted in such a device having a large number of tone generation channels and a large number of operation units when a tone color or a performance mode which does not required a large number of operation units per one tone generation channel has been selected.

SUMMARY OF THE INVENTION

It is, therefore, an object of the present invention to provide a tone signal generation device capable of generating plural tones simultaneously by the operation type tone generation system, which utilizes a limited number of operation channels (operation units) efficiently and without waste and which changes the maximum number of tones that can be sounded simultaneously as desired.

For achieving the above described object, the tone signal generation device of the present invention comprises tone generation operation means including a predetermined number of operation channels for tone signal computation and generating a tone signal by performing a specific tone generation operation employing one or more of said operation channels for one tone generation channel, wherein a plurality of said tone generation channels are established thereby enabling generation of plural tones, mode selection means for selecting one mode for among a plurality of modes, and channel establishing means for dividing said operation channels into plural groups in a predetermined manner in accordance with the mode selected by said mode selection means and establishing said tone generation channels so that each is constituted by one of the operation channel groups, the number of said groups being different depending upon the selected mode. The number of the tone generation channels in said tone generation operation means and the number of operation channels in each group can therefore be changed in accordance with the selected mode.

BRIEF DESCRIPTION OF THE DRAWINGS

In the accompanying drawings.

DETAILED DESCRIPTION

Figure 1:
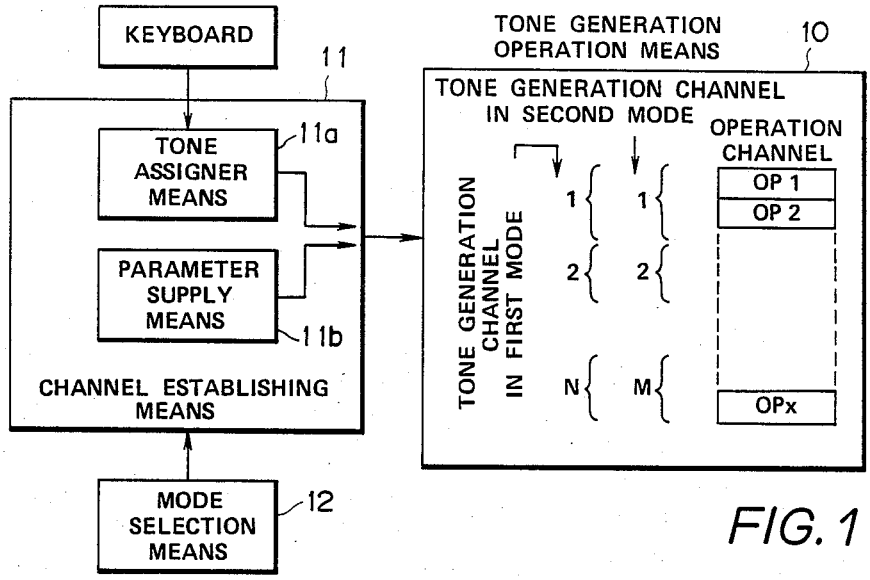
FIG. 1 is a functional block diagram showing the basic organization of the invention.

The basic construction of this tone signal generation device will be described with reference to FIG. 1. Tone generation operation means 10 includes operation channels OP1–OPx of a specific number x. The respective operation channels OP1–OPx each implement a respective basic computing operation of a predetermined tone generation operation. A tone signal is generated by performing the predetermined tone generation operation employing one or more operation channels OP-1–OPx for one tone generation channel. A plurality of such tone generation channels employing one or more operation channels OP1–OPx are established by a channel establishing means 11 and simultaneous generation of plural tones thereby is made possible. The channel establishing means 11 establishes the tone generation channels in the tone generation operation means 10 in different modes in accordance with a mode (e.g., either a first mode or a second mode) selected by a mode selection means 12. In the first mode, the operation channels OP1–OPx are divided into N groups in a predetermined manner and N tone generation channels are established corresponding to the respective N groups. In the second mode, the operation channels OP1–OPx are divided into M ($N \neq M$) groups in a predetermined manner and M tone generation channels are established in correspondence to the respective M groups. In this manner, the number of tone generation channels in the tone generation operation means 10 can be switched to N or M in accordance with the selected mode. The number of modes is not limited to two.

Thus, the operation channels OP1–OPx of a specific number x are divided into N or M groups depending upon the selected mode (the number of the operation channels within each group is not necessarily equal to that of the other groups) and the tone generation channels are established according to these groups.

Accordingly, the number of tone generation channels can be changed so that the maximum number of tones which can be sounded simultaneously can be suitably changed by changing modes. In a case where a tone of a high quality is to be obtained or a complex tone color control is to be performed, i.e., where a relatively large number of operation channels need to be used for one tone generation channel, the grouping of the operation channels is established to serve this purpose and the mode is changed to one in which the number of the tone generation channels is relatively decreased. Conversely, in a case where a relatively simple tone color control is to be performed or the number of the tone generation channels is to be relatively increased, i.e., where the number of the operation channels used for one tone generation channel can be relatively small, the grouping of the operation channels is established to serve this purpose and the mode is changed to one in which the number of the tone generation channels is relatively increased.

In this manner, operation channels of a limited number can be utilized efficiently and without waste so as to increase or decrease the maximum number of tones to be sounded simultaneously as desired whereby the two requirements of improvement in tone quality and an increase in the number of tones to be sounded simultaneously can be selectively realized by using a device of a limited construction.

For example, in FIG. 1 the channel establishing means 11 includes a tone assigner means 11*a* and a parameter supply means 11*b* as shown. The tone assigner means 11*a* assigns a tone to be generated to N or M tone generation channels established in accordance with the mode selected by the mode selection means 12. In other words, the number of the tone generation channels which are subjected to the assignment by the tone assigner means 11*a* increases or decreases depending upon the mode. Information representing the tone pitches of tone which have been assigned to the respective tone generation channels is supplied to the tone generation operation means 10 in accordance with operation channel groups corresponding to the tone generation channels. The parameter supply means 11*b* supplies operation parameters for respective operation channels in the N or M tone generation channels established in accordance with the selected mode. The tone generation operation means 10 establishes operation algorithms and operation coefficients in response to the operation parameters supplied to the respective operation channels and, in accordance with these operation algorithms and operation coefficients, and also with the information representing the tone pitches of the tones assigned to the respective tone generation channels, performs the tone generation operation (computation) and generates tone signals from the respective tone generation channels.

An embodiment of the invention will not be described in detail with reference to the subsequent drawings.

Figure 2:
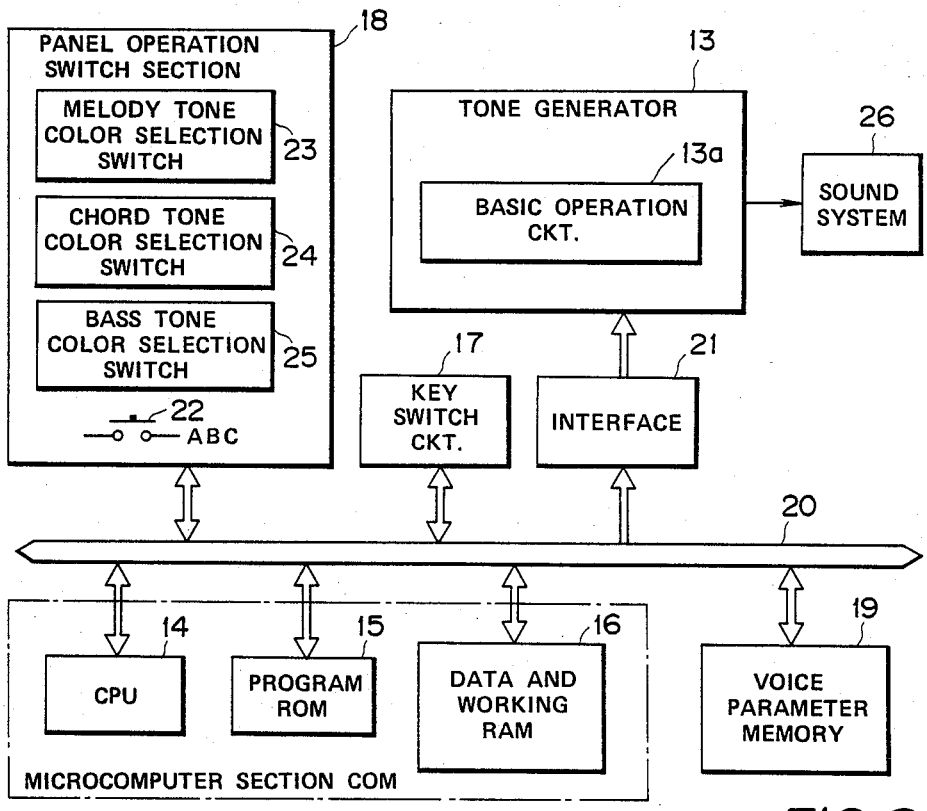
FIG. 2 is a block diagram showing the hardware construction of an electronic musical instrument incorporating an embodiment of the invention.

FIG. 2 is a block diagram schematically showing a hardware construction, i.e., an electrical circuitry, of a keyboard type electronic musical instrument which is an embodiment of the tone signal generation device according to the invention. In this embodiment, there is provided a tone generator 13 corresponding to the above described tone generation operation means 10. In the example shown, the tone generator 13 comprises a basic operation circuit 13*a* which is preferably of the FM type, but can also be of the AM type. A plurality of operation channels of a specific number x (in the present embodiment, x is assumed to be 32) are provided in the form of time division time slots by using this basic operation circuit 13*a* on a time shared basis. For distinguishing the operation channels from the tone generation channels, the operation channels will be referred to as "operation time slots" or "operation slots" in the following description and the term "channel" will be used to designate the tone generation channels unless otherwise particularly specified.

This electronic musical instrument comprises a microcomputer section COM including a CPU (central processing unit) 14, a program ROM (read-only memory) 15 and a data and working RAM (random-access memory) 16. A key switch circuit 17 consisting of keys in a keyboard, a panel operation switch section 18 and a voice parameter memory 19 are connected to the microcomputer section COM through a bus 20. The tone generator 13 is connected also to the microcomputer section COM through an interface 21 and the bus 20. By controlling this microcomputer section COM, key switches in the key switch circuit 17 are scanned, the depression or release of keys are thereby detected and a process for assigning the generation of the tone of the depressed key to any particular one of a plurality of tone generation channels is effected. Further, by controlling the microcomputer section COM, the operation states of various switches and operation knobs in the panel operation switch section 18 are scanned and processings according to the results of the scanning (including a processing corresponding to the channel establishing means 11 in FIG. 1) are executed.

The panel operation switch section 18 comprises an automatic bass/chord performance (hereinafter sometimes referred to as ABC) selection switch 22, a melody tone color selection swtich 23, a chord tone color selection switch 24, a bass tone color selection switch 25 and various other switches controlling tone color, tone level and tonal effects, and display means associated to these switches.

The ABC selection switch 22 corresponds to the mode selection means 12. When the automatic bass/-chord performance is not selected by this switch 22, the device is in a first mode (referred also as a "normal mode") and when the automatic bass/chord performance is selected by the switch 22, the device is in a second mode (referred also to as the "ABC mode"). The tone color selection switches 23, 24 and 25 are provided for respectively selecting tone colors for playing melody tones, bass tones and chord tones.

In the present embodiment, the keyboard is constructed as a single-stage keyboard. In the normal mode, all keys are used for playing melody tones whereas in the ABC mode, a key range on the higher side of a predetermined key is used as a melody key range and a key range on the lower side of the predetermined key as an accompaniment key range. In the normal mode, a tone corresponding to a key depressed in the keyboard is generated with a melody tone color imparted thereto in accordance with the key depressing operation. In the ABC mode, a tone corresponding to a key depressed in the melody key range is generated with a melody color imparted thereto in accordance with the key depressing operation while a base tone and a chord tone are formed in accordance with a key depressed in the accompaniment key range, and the tones thus imparted with the melody tone, the bass tone and the chord tone are generated in accordance with an automatic tone generation timing.

The voice parameter memory 19 consists, for example, of a ROM and stores parameters (hereinafter referred to as voice parameters) necessary for producing various tone colors selectable by the tone color selection switches 23–25 in correspondence to these tone colors. Voice parameters corresponding to the tone colors selected by the respective switches 23–25 are read out from this voice parameter memory 19. The read out voice parameters are supplied to the tone generator 13 as a part of the operation parameters.

Figures 3, 4:
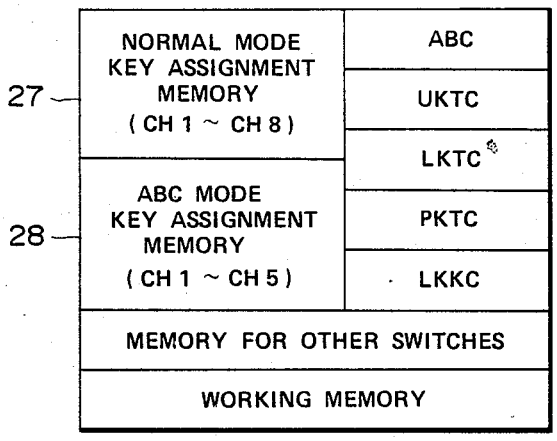
FIG. 3 is an example of a manner of establishing channels in each of two modes in the embodiment of FIG. 2.
FIG. 4 is a diagram showing an example of the structuring of the memory in the data and working RAM shown in FIG. 2.

FIG. 3 shows an example of a channel establishment in each mode. The contents of the channel establishment are programmed by the microcomputer section COM so as to become those shown in FIG. 3 in accordance with the mode selected. In the normal mode, the thirty-two operation channels i.e., operation time slots, are divided into eight groups each consisting of four operation channels. Eight tone generation channels CH1–CH8 are designated by the eight groups. An arrangement is made so that a tone signal will be generated with a melody tone color common through all of the eight tone generation channels. In the ABC mode, six tone generation channels CH1–CH6 are provided corresponding to six groups each consisting of four operation channels and four tone generation channels CH7 –CH10 are provided in corespondence to four groups each consisting of two operation channels. In this case, five of the tone generation channels CH1–CH5 are used for generating tones having the melody tone color and four of the tone generation channels CH7–CH10 are used for generating tones having the chord tone color. In the foregoing manner, eight tone generation channels are used in the normal mode whereas ten tone generation channels are used in the ABC mode. Alternatively stated, the groups for the tone generation channels CH7 and CH8 each consisting of four operation channels (7, 15, 23, 31) and (8, 16, 24, 32) are respectively divided in half thereby respectively providing four groups each consisting of two operation channels. As a result, four tone generation channels CH7–CH10 are provided in correspondence to the four groups each consisting of two operation channels (7,23), (8,24), (15,31) and (16,32).

In accordance with the differences in the contents of the channel establishment, depending upon the mode, contents of the key assigning processings in the microcomputer section COM become different depending upon the mode and the manner of supplying the voice parameters becomes also different depending upon the mode. Data and voice parameters corresponding to the tone pitches of tones assigned to the tone generation channels CH1–CH8 or CH1–CH10 which vary depending upon the mode are supplied from the microcomputer section COM to the tone generator 13 through the interface 21. The tone generator 13 performs an eight-channel type of ten-channel type tone generation operation in accordance with the data supplied from the microcomputer section COM. The generated tone signal is supplied to a sound system 26.

FIG. 4 shows an example of a memory structure in the data and working RAM 16. An ABC register stores a signal indicating whether the selected mode is the ABC mode or not. When this signal is "1", the selected mode is the ABC mode and when the signal is "0", the selected mode is the normal mode. Contents of this ABC register are switched by operation of the ABC selection switch 22. A UKTC register stores data (a melody tone color code UKTC) representing a melody tone color selected by the melody tone color selection switch 23. An LKTC register stores data (a chord tone color code LKTC) representing a chord tone color selected by the chord tone color selection switch 24. A PKTC register stores data (a bass tone color code PKTC) representing a bass tone color selected by the bass tone color selection switch 25. An LKKC memory stores a key code of a key depressed in the accompaniment key range (an accompaniment key range code LKKC). A normal mode key assignment memory 27 stores a key code KC and a key-on signal KON of a key which has been assigned to one of the tone generation channels CH1–CH8 for the melody tone color in the normal mode. An ABC mode key assignment memory 28 stores a key code KC and a key-on signal KON of a key which has been assigned to one of the tone generation channels CH1–CH5 for the melody tone color in the ABC mode.

Figure 5:
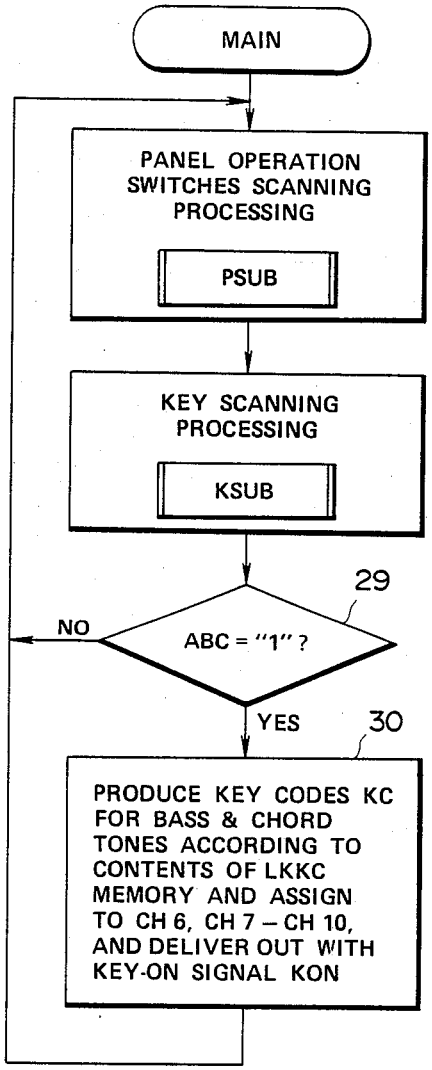
FIG. 5 is a flow chart schematically showing an example of a main routine of a program executed by a microcomputer unit in FIG. 2.
Figure 6:
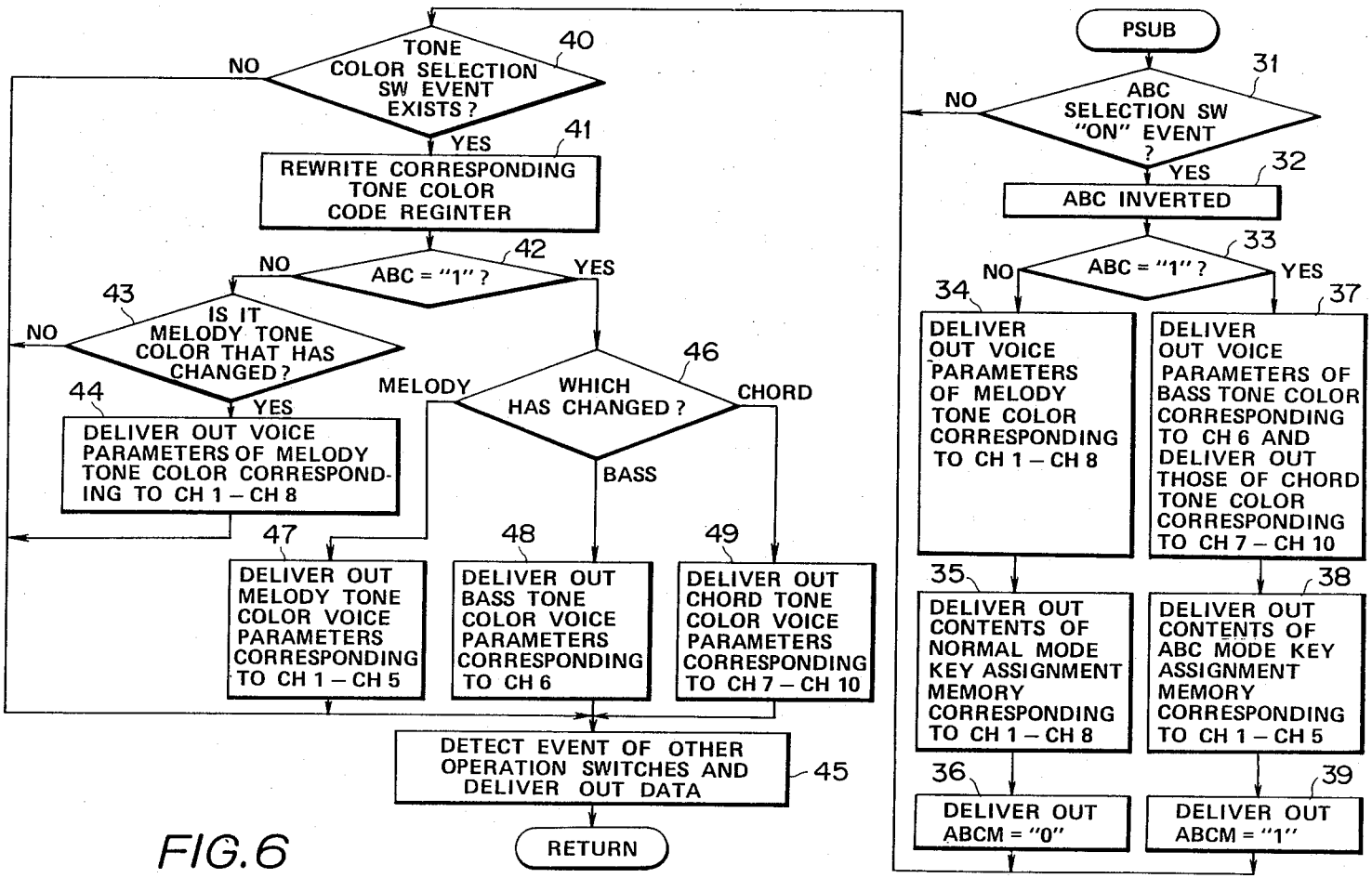
FIG. 6 is a flow chart showing an example of a panel scanning subroutine executed in the panel operator scanning processing of FIG. 5.

An example of the program executed by the microcomputer section COM will be be described. FIG. 5 schematically shows the main routine of the program. In "panel operation switches scanning processing", respective switches in the panel operation switch section 18 are scanned and a predetermined processing is executed in accordance with results of the scanning. In this processing, a panel scanning subroutine PSUB as shown in FIG. 6 is executed. In "key scanning processing", respective keys in the key switch

What is claimed is:

1. A tone signal generation device having a plurality of tone generation channels, comprising:

tone generation operation means, including a predetermined number of operation channels, for tone signal computation and generating one or more tone signals by performing a specific tone generation operation employing one or more of said operation channels for one tone generation channel, thereby providing said plurality of tone generation channels;

mode selection means for selecting one mode from among a plurality of modes including a first mode and a second mode; and channel establishing means for dividing said operation channels into plural groups in a predetermined manner in accordance with the mode selected by said mode selection means and establishing said tone generation channels as being each constituted by a respective one of the plural groups, the number of said groups being different depending upon the selected mode to change the number of tone generation channels in said tone generation operation means in accordance with the selected mode.

2. A tone signal generation device as defined in claim 1 wherein said channel establishing means comprises tone assignment means for assigning tones to be generated to the tone generation channels established in accordance with the mode selected by said mode selection means and parameter supply means for supplying operation parameters to the respective operation channels in the tone generation channels established according to the selected mode.

3. A tone generation device as defined in claim 1 wherein said mode selection means selects either the first mode or the second mode, and said channel establishing means divides the operation channels into N groups in said first mode to establish N tone generation channels corresponding to the respective N groups and divides the operation channels into M groups in said second mode to establish M tone generation channels corresponding to the respective M groups.

4. A tone signal generation device as defined in claim 3 wherein in said second mode, an operation channel group corresponding to one tone generation channel among the N tone generation channels in said first mode is divided into at least two groups and independent tone generation channels are established by the respective divided groups thereby to establish a total of M ($N<M$) tone generation channels.

5. A tone signal generation device as defined in claim 1 wherein in said first mode, the number of the operation channels for each of the tone generation channels is the same and tone signals generated thereby are each generated with a common tone color whereas in said second mode, there is a tone generation channel whose number of operation channels is different from those of another of the tone generation channels whereby the tone signals generated by tone generation channels whose number of operation channels differ from each other have different tone colors from each other.

6. A tone signal generation device as defined in claim 5 wherein a waveshape signal having a particular waveshape and plural phase sections is used for the operation in the operation channels in said tone generation operation means and the tone signal generation device includes waveshape changing means for changing the waveshape of a predetermined waveshape signal in a specific phase section thereof in response to a control signal and, wherein in said second second mode, the particular waveshape of the waveshape signal is changed by supplying the control signal to one or more of the operation channels in those tone generation channels in which the number of operation channels is relatively small in comparison to others of the tone generation channels so that harmonic components in the changed waveshape signal used for the respective one or more operation channels are changed.

7. A tone signal generation device as defined in claim 1 wherein said tone generation operation means provides said predetermined number of opeation channels in the form of time division time slots and wherein a single basic tone generation operation circuit is used on a time shared basis to compute and generate the one or more tone signals.

8. A tone generation device as defined in claim 1 wherein each of said operation channels in said tone generation operation means includes FM means for performing a basic operation of tone generation system according to a frequency modulation operation.

9. A tone signal generation device as defined in claim 3 wherein said mode selection means includes an automatic performance selection switch for selecting an automatic performance and the mode selection means selects said first mode when the automatic performance has not been selected and selects said second mode when the automatic performance has been selected by said switch, wherein some of the tone generation channels established in said second mode are used as channels for the automatic performance and the rest of the tone generation channels established in said second mode are used as channels for a manual performance.

10. A plural channel tone generation device comprising:

an operation unit means having a predetermined number of operation units each adapted for performing a specific tone generation operation; and a channel establishing means for assigning each operation unit to one of a plurality of specific groups, the number of operation units in each specific group defining a tone generation channel, wherein the channel establishing means includes an operation unit number changing means for changing the number of operation units in at least one of the specific groups in accordance with a preselected operation mode thereby to change the number of operation units in the corresponding tone generation channel.

* * * * *

UNITED STATES PATENT AND TRADEMARK OFFICE

CERTIFICATE OF CORRECTION

PATENT NO. : 4,788,896

DATED : December 6, 1988

INVENTOR(S) : Yassuji Uchiyama et al

It is certified that error appears in the above-identified patent and that said Letters Patent is hereby corrected as shown below:

The title page, Drawings and Specification should be deleted to appear as per attached sheets.

Signed and Sealed this

Fourteenth Day of January, 1992

*Attest:*

HARRY F. MANBECK, JR.

*Attesting Officer*

*Commissioner of Patents and Trademarks*

United States Patent [19]

Uchiyama et al.

[11] Patent Number: 4,788,896

[45] Date of Patent: Dec. 6, 1988

[54] TONE GENERATOR HAVING A VARIABLE NUMBER OF CHANNELS WITH A VARIABLE NUMBER OF OPERATING UNITS

[75] Inventors: Yasuji Uchiyama; Shigeru Suzuki, both of Hamamatsu, Japan

[73] Assignee: Nippon Gakki Seizo Kabushiki Kaisha, Hamamatsu, Japan

[21] Appl. No.: 875,479

[22] Filed: Jun. 18, 1986

[30] Foreign Application Priority Data

Jun. 21, 1985 [JP] Japan ..... 60-135793

[51] Int. Cl.[4] ..... G10H 1/06; G10H 7/00

[52] U.S. Cl. ..... 84/1.01; 84/1.03; 84/1.19; 84/1.24; 340/365 S

[58] Field of Search ..... 84/1.01, 1.03, 1.19, 84/1.24, DIG. 12, DIG. 22; 340/365 S

[56] References Cited

U.S. PATENT DOCUMENTS 3,882,751 5/1975 Tomisawa et al. ..... 84/1.01
4,018,121 4/1977 Chowning ..... 84/1.01
4,543,869 10/1985 Kawashima et al. ..... 84/1.01

FOREIGN PATENT DOCUMENTS 29519 6/1983 Japan .

*Primary Examiner*—Stanley J. Witkowski
*Attorney, Agent, or Firm*—Spensley Horn Jubas & Lubitz

[57] ABSTRACT

A tone generator includes a plurality of tone generation channels each comprising one or more operation channels. One operation channel performs basic operation of a tone signal computing operation (e.g., FM or AM) and a tone signal is generated by using one or more operation channels for one tone generation channel. Tone generation channels in the tone generator are established according to a selected performance mode. In a first mode, the operation channels are divided into N groups and N tone generation channels are established in correspondence to the respective operation channel groups. In a second mode, the operation channels are divided into M groups and M tone generation channels are established in correspondence to the respective operation channel groups wherein N is a different number from M. Tone generation channels of the number required according to the selected performance mode can be established by efficiently utilizing the operation channels of a limited number.

10 Claims, 9 Drawing Sheets

| NORMAL MODE | | | ABC MODE | | |
|---|---|---|---|---|---|
| TONE GENERATION CHANNEL | OPERATION CHANNEL | TONE | TONE GENERATION CHANNEL | OPERATION CHANNEL | TONE |
| CH 1 | 1, 9, 17, 25 | MELODY | CH 1 | 1, 9, 17, 25 | MELODY |
| CH 2 | 2, 10, 18, 26 | | CH 2 | 2, 10, 18, 26 | |
| CH 3 | 3, 11, 19, 27 | | CH 3 | 3, 11, 19, 27 | |
| CH 4 | 4, 12, 20, 28 | | CH 4 | 4, 12, 20, 28 | |
| CH 5 | 5, 13, 21, 29 | | CH 5 | 5, 13, 21, 29 | |
| CH 6 | 6, 14, 22, 30 | | CH 6 | 6, 14, 22, 30 | BASS |
| CH 7 | 7, 15, 23, 31 | | CH 7 | 7, 23 | CHORD |
| | | | CH 8 | 8, 24 | |
| CH 8 | 8, 16, 24, 32 | | CH 10 | 16, 32 | |

RAM 16

TONE GENERATOR HAVING A VARIABLE NUMBER OF CHANNELS WITH A VARIABLE NUMBER OF OPERATING UNITS

BACKGROUND OF THE INVENTION

This invention relates to a tone signal generation device and, more particularly, to a device capable of generating a tone signal of a desired tone color by performing a tone generating operation (computation) such as a frequency modulation operation and amplitude modulation operation. More particularly, the invention relates to a tone signal generation device in which a plurality of tone generation channels are provided for enabling simultaneous sounding of plural tones and which is capable of changing the maximum number of tones simultaneously produced depending upon a tone or tones to be produced.

A basic system for generating a tone signal by using a frequency modulation (hereinafter abbreviated as FM) operation in the audio frequency range is disclosed in the U.S. Pat. No. 4,018,121. A basic system for generating a tone signal by using an amplitude modulation (hereinafter abbreviated as AM) operation in the audio range is disclosed in Japanese Patent Publication No. 29519/1983. Known also in the art is an electronic musical instrument which includes a limited number of tone generation channels wherein the sounding of a tone for a depressed key is assigned to any of the tone generation channels whereby different tones corresponding in number to the number of the tone generation channels can be simultaneously produced (e.g., the U.S. Pat. No. 3,882,751).

It is also known to employ one of the above described basic operation systems (FM or AM) as a tone generation system in each of such a plurality of tone generation channels and to sound plural tones generated by such operation systems simultaneously. In such prior art electronic musical instruments, the number of tone generation channels is fixed and it is not possible to change this number depending upon the situation.

In a tone generation system employing the above described operation systems, one or more basic operation units (or operation channels) are used in one tone generation channel and operation parameters in each operation unit are suitably selected to generate a tone signal of a desired tone color. In this case, the more the operation units are used, the more various and complex tone color control one can realize. Therefore, the number of basic operation units per one tone generation channel should preferably be large if the tone color or quality of a tone to be achieved is important. Further, there is a case in which a sufficient number of basic operation units are required depending upon the tone color or performance mode selected. On the other hand, there is also a case in which the number of the operation units per one tone generation channel need not be large whereas the number of tones which can be sounded simultaneously should be large. For satisfying the former requirement, the number of the operation units (operation channels) per one tone generation channel must be sufficiently large whereas for satisfying the latter requirement, the number of the tone generation channels must be large. Therefore, there arises the problem that it requires a large and costly device to satisfy both these requirements. Although a plurality of operation units can be realized by using a single basic the number of operation units obliges an increase in the time division clock rate which result in a rise in the manufacturing cost. Further, aside from such problems, many unused operation units (operation channels) will be wasted in such a device having a large number of tone generation channels and a large number of operation units when a tone color or a performance mode which does not required a large number of operation units per one tone generation channel has been selected.

SUMMARY OF THE INVENTION

It is, therefore, an object of the present invention to provide a tone signal generation device capable of generating plural tones simultaneously by the operation type tone generation system, which utilizes a limited number of operation channels (operation units) efficiently and without waste and which changes the maximum number of tones that can be sounded simultaneously as desired.

For achieving the above described object, the tone signal generation device of the present invention comprises tone generation operation means including a predetermined number of operation channels for tone signal computation and generating a tone signal by performing a specific tone generation operation employing one or more of said operation channels for one tone generation channel, wherein a plurality of said tone generation channels are established thereby enabling generation of plural tones, mode selection means for selecting one mode for among a plurality of modes, and channel establishing means for dividing said operation channels into plural groups in a predetermined manner in accordance with the mode selected by said mode selection means and establishing said tone generation channels so that each is constituted by one of the operation channel groups, the number of said groups being different depending upon the selected mode. The number of the tone generation channels in said tone generation operation means and the number of operation channels in each group can therefore be changed in accordance with the selected mode.

BRIEF DESCRIPTION OF THE DRAWINGS

Figure 7:
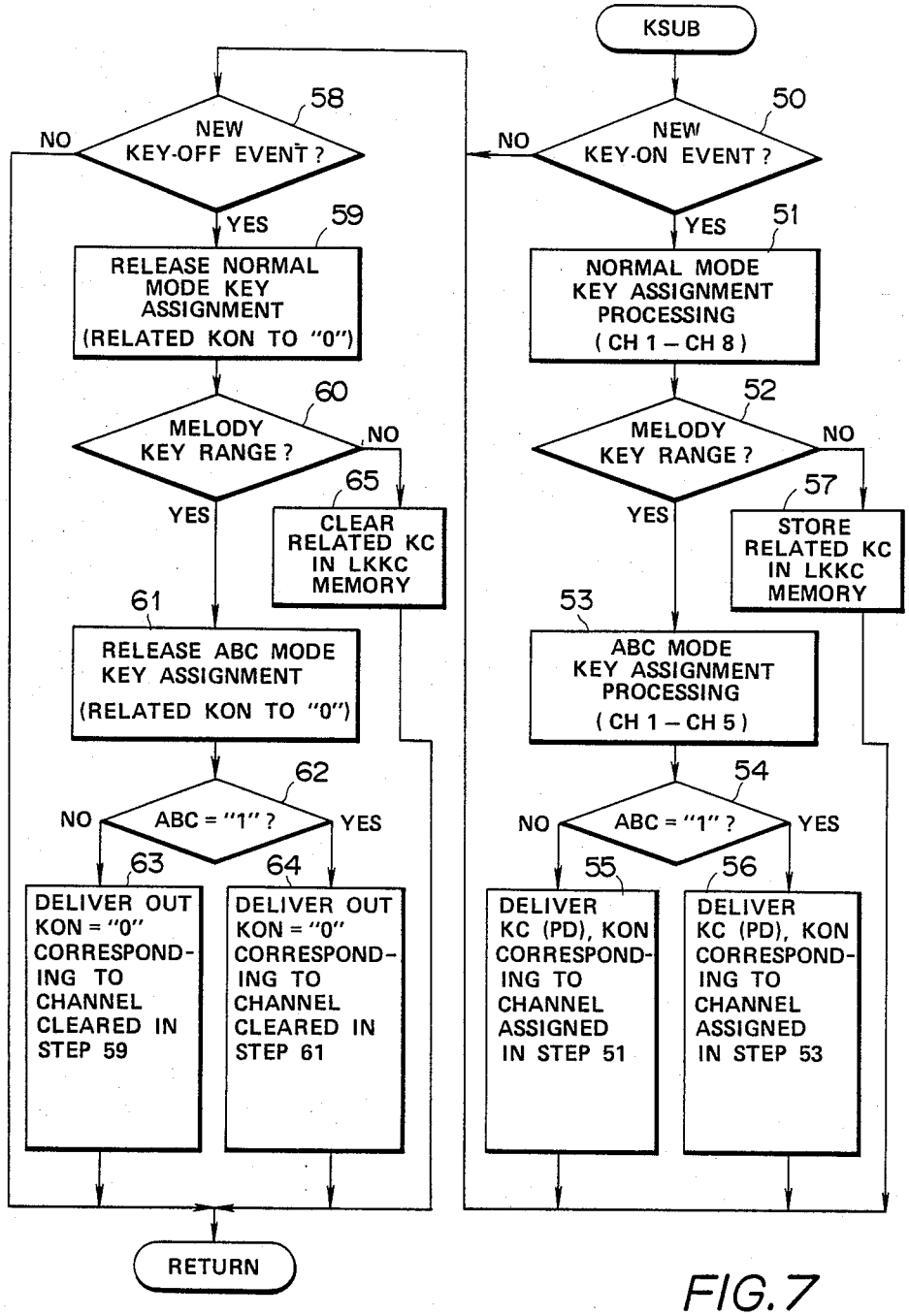
FIG. 7 is a flow chart showing an example of a key scanning subroutine executed in the key scanning processing of FIG. 5.
Figure 8:
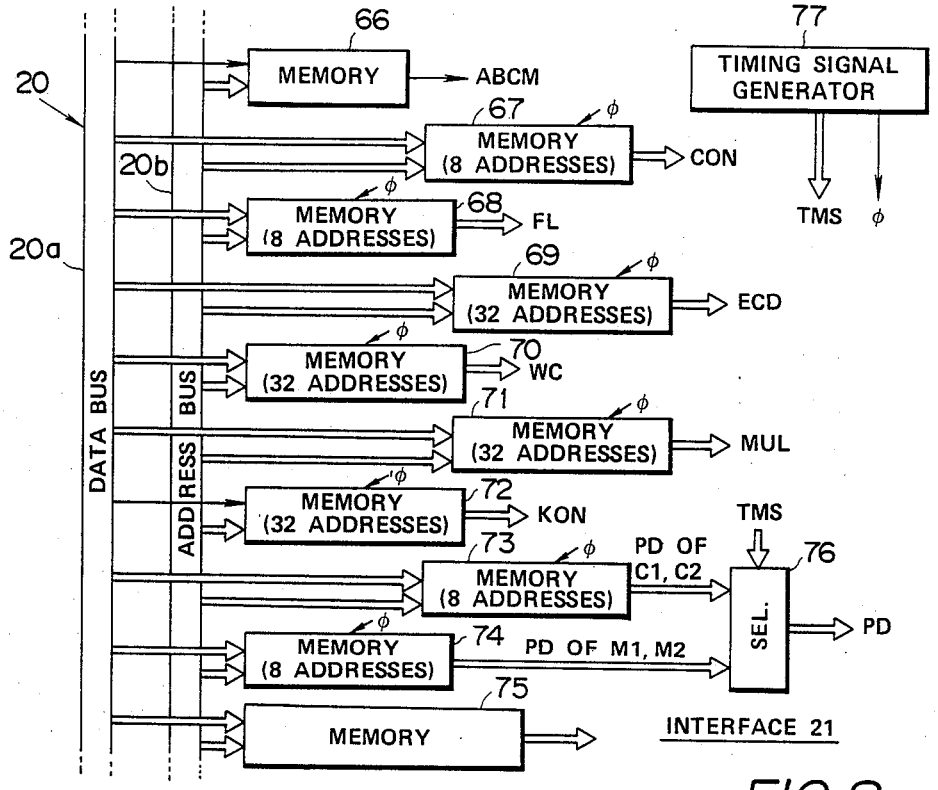
FIG. 8 is a block diagram showing an example of an interface for the embodiment of FIG. 2.

In the accompanying drawings,

FIG. 1 is a functional block diagram showing the basic organization of the invention;

FIG. 2 is a block diagram showing the hardware construction of an electronic musical instrument incorporating an embodiment of the invention;

FIG. 3 is an example of a manner of establishing channels in each of two modes in the embodiment of FIG. 2;

FIG. 4 is a diagram showing an example of the structuring of the memory in the data and working RAM shown in FIG. 2;

FIG. 5 is a flow chart schematically showing an example of a main routine of a program executed by a microcomputer unit in FIG. 2;

FIG. 6 is a flow chart showing an example of a panel scanning subroutine executed in the panel operator scanning processing of FIG. 5;

FIG. 7 is a flow chart showing an example of a key scanning subroutine executed in the key scanning processing of FIG. 5;

FIG. 8 is a block diagram showing an example of an

Figure 9:
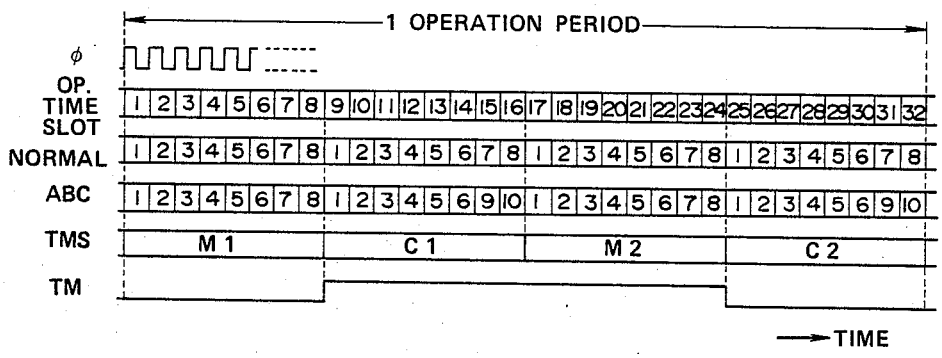
FIG. 9 is a time charge showing an example of the relationship between a plurality of time division time slots corresponding to thirty-two operation channels and a plurality of tone generaton channels during a normal mode and an ABC mode corresponding to the respective time slots and also showing an example of timing signal.
Figure 10:
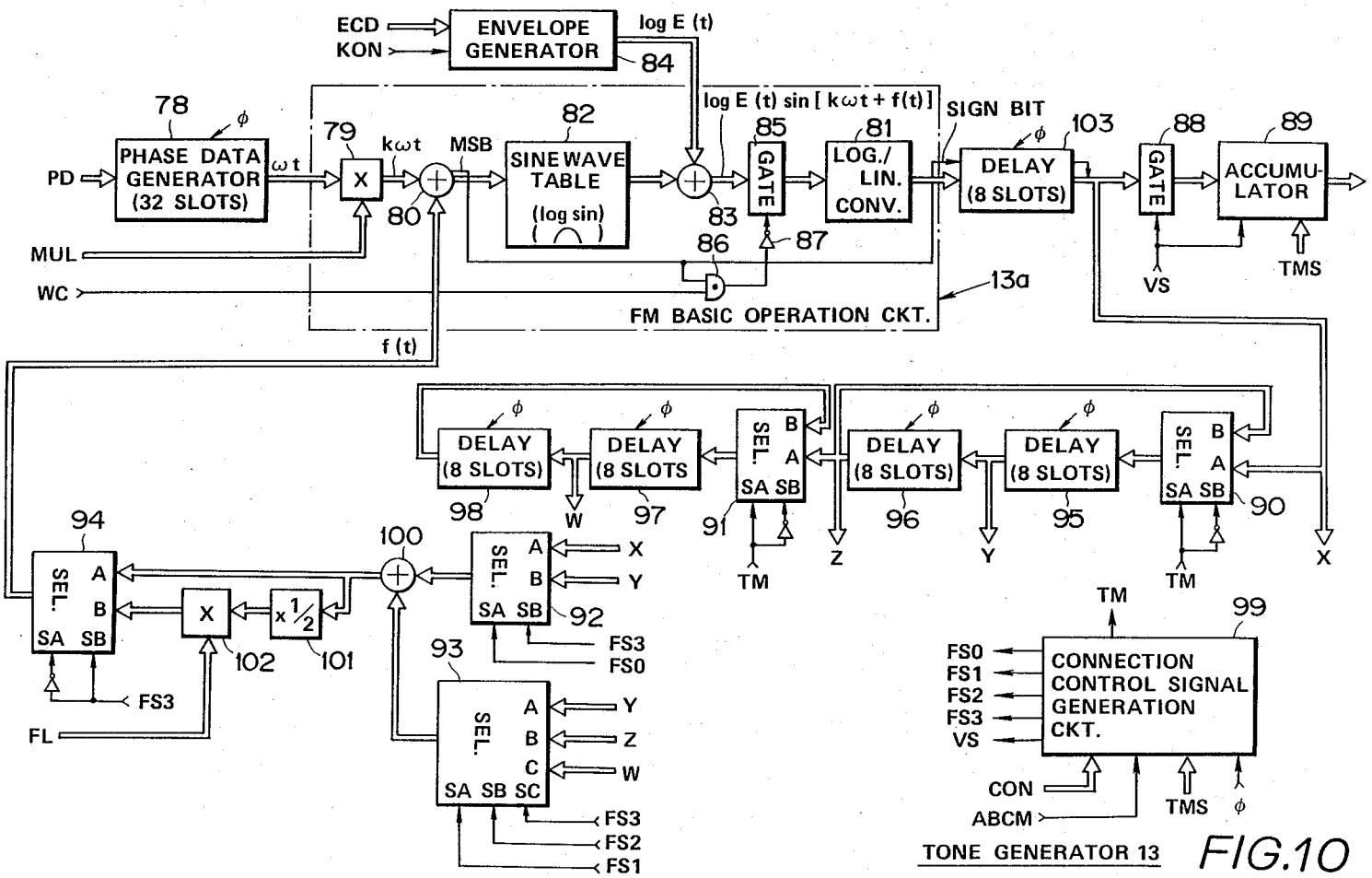
FIG. 10 is a block diagram showing an example of the internal construction of a tone generator in the embodiment of FIG. 2.
Figure 11:
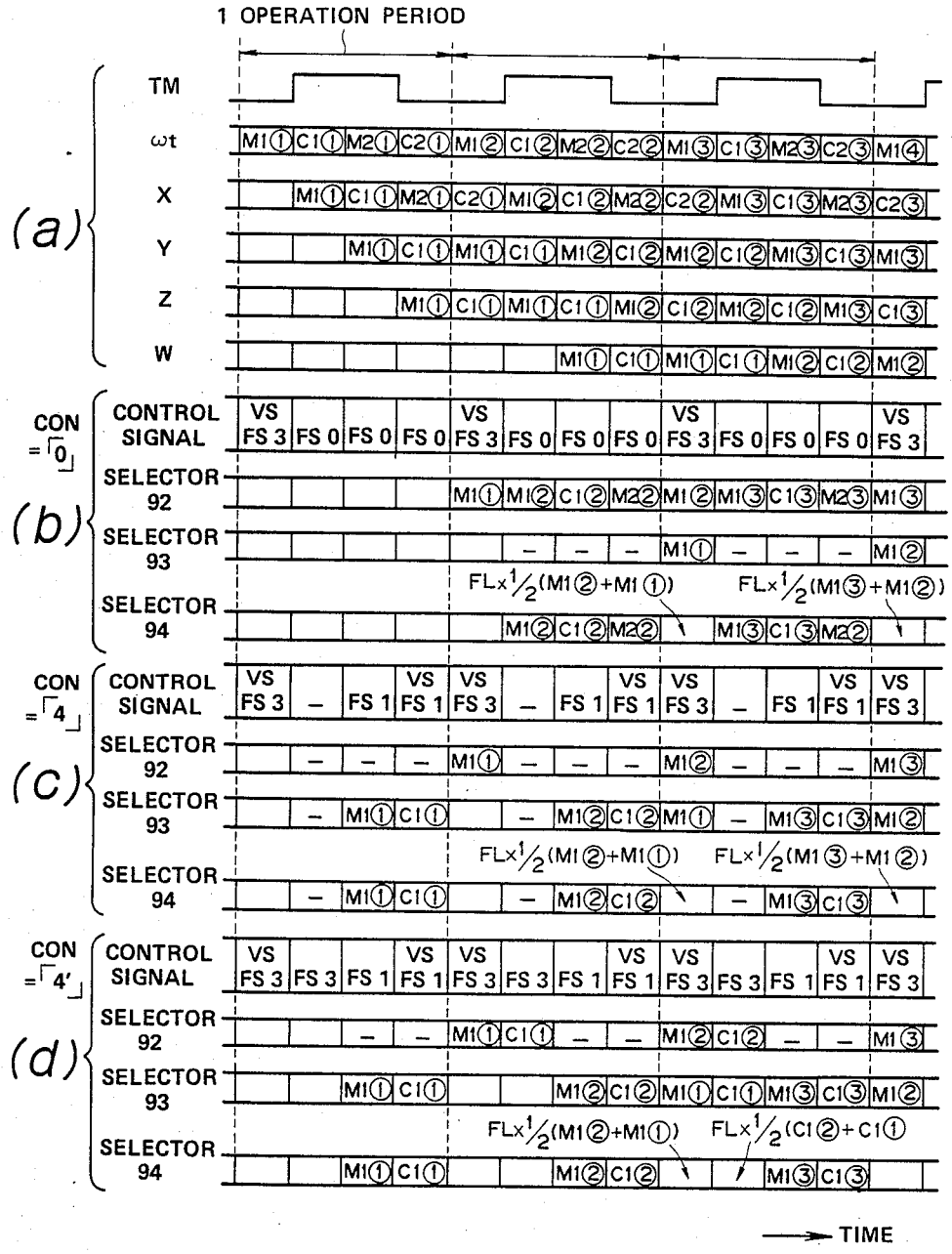
FIGS. 11 (*a*)-(*d*) are time charts showing an example of the operation of the circuit of FIG. 10.
Figure 12:
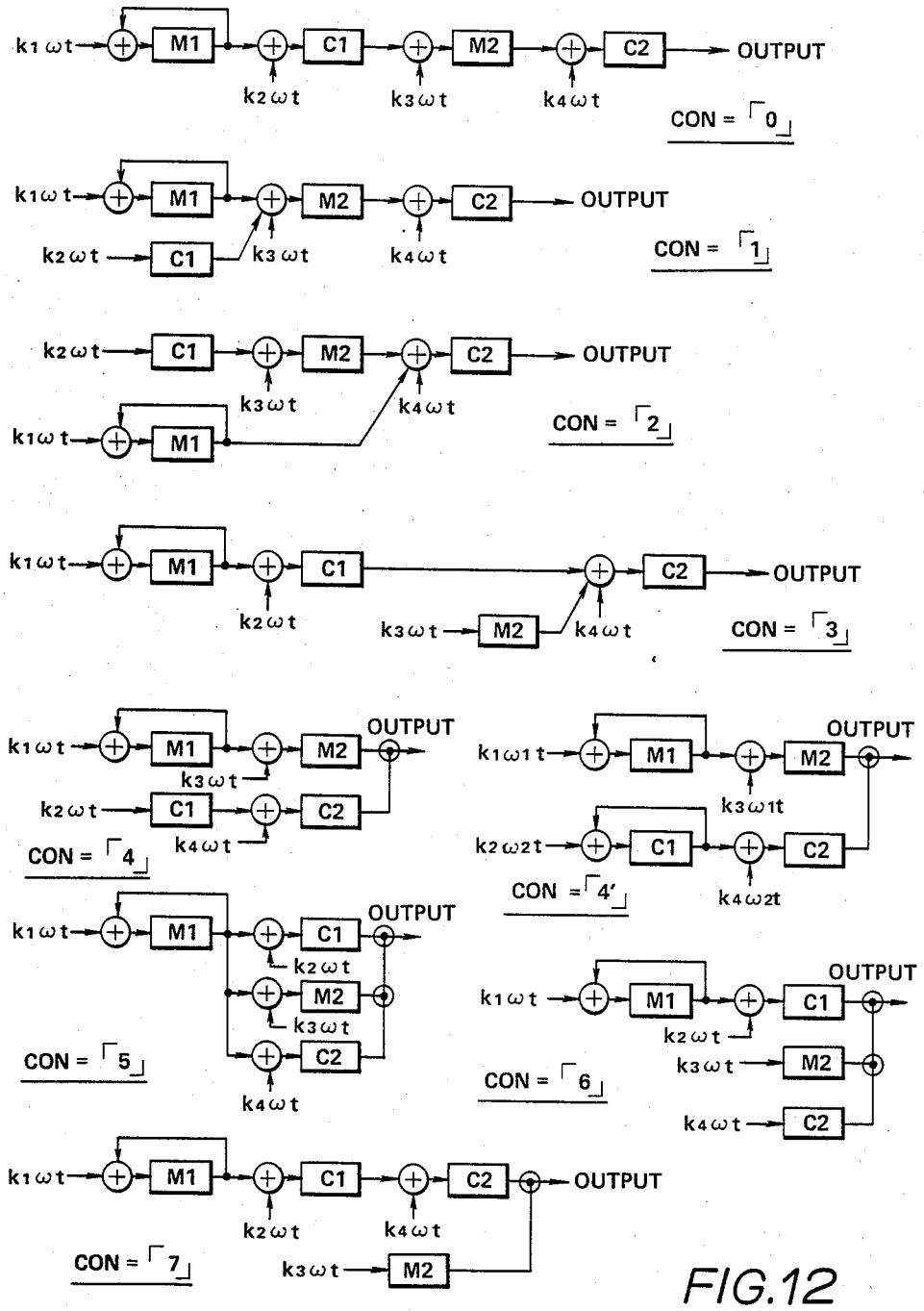
FIG. 12 is a schematic block diagram showing an example of a manner of connecting operation channels in one tone generation channel.
Figure 1:
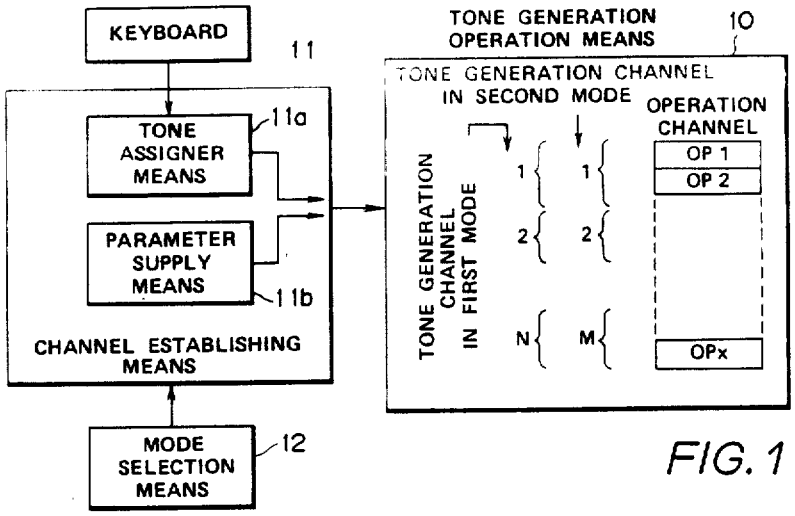
Figure 2:
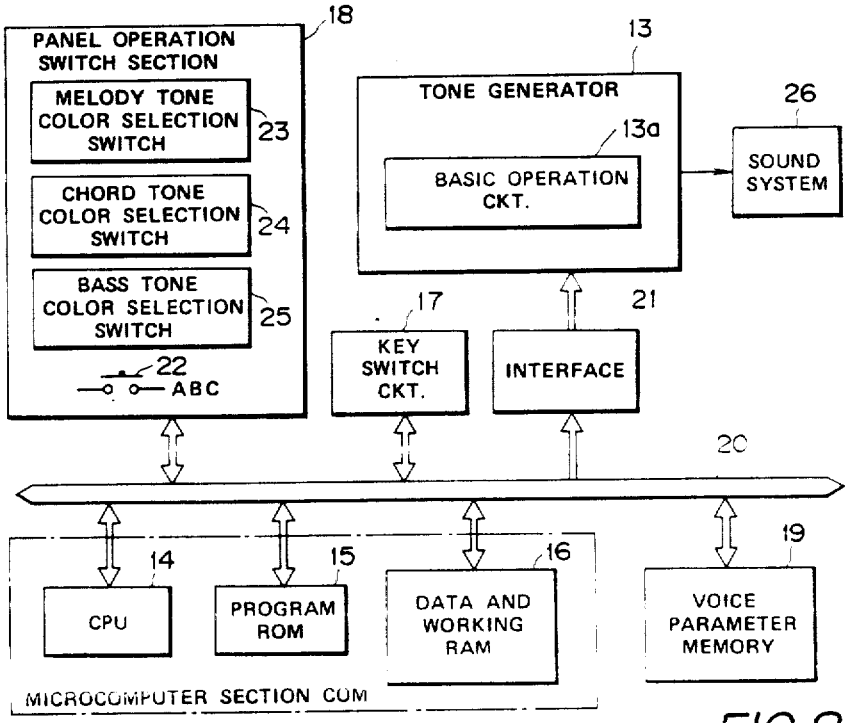
Figures 3, 4:
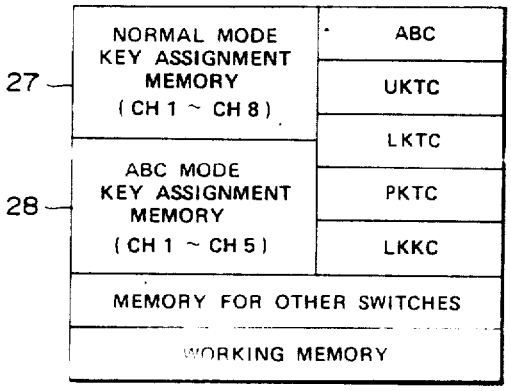
Figure 5:
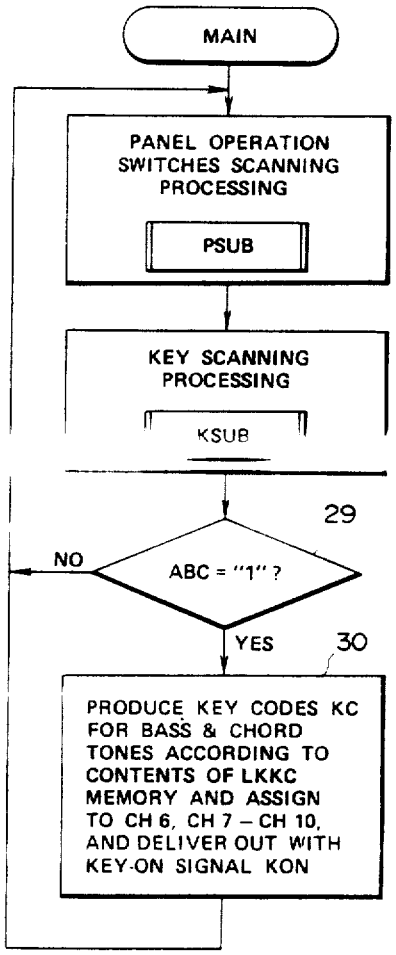
Figure 6:
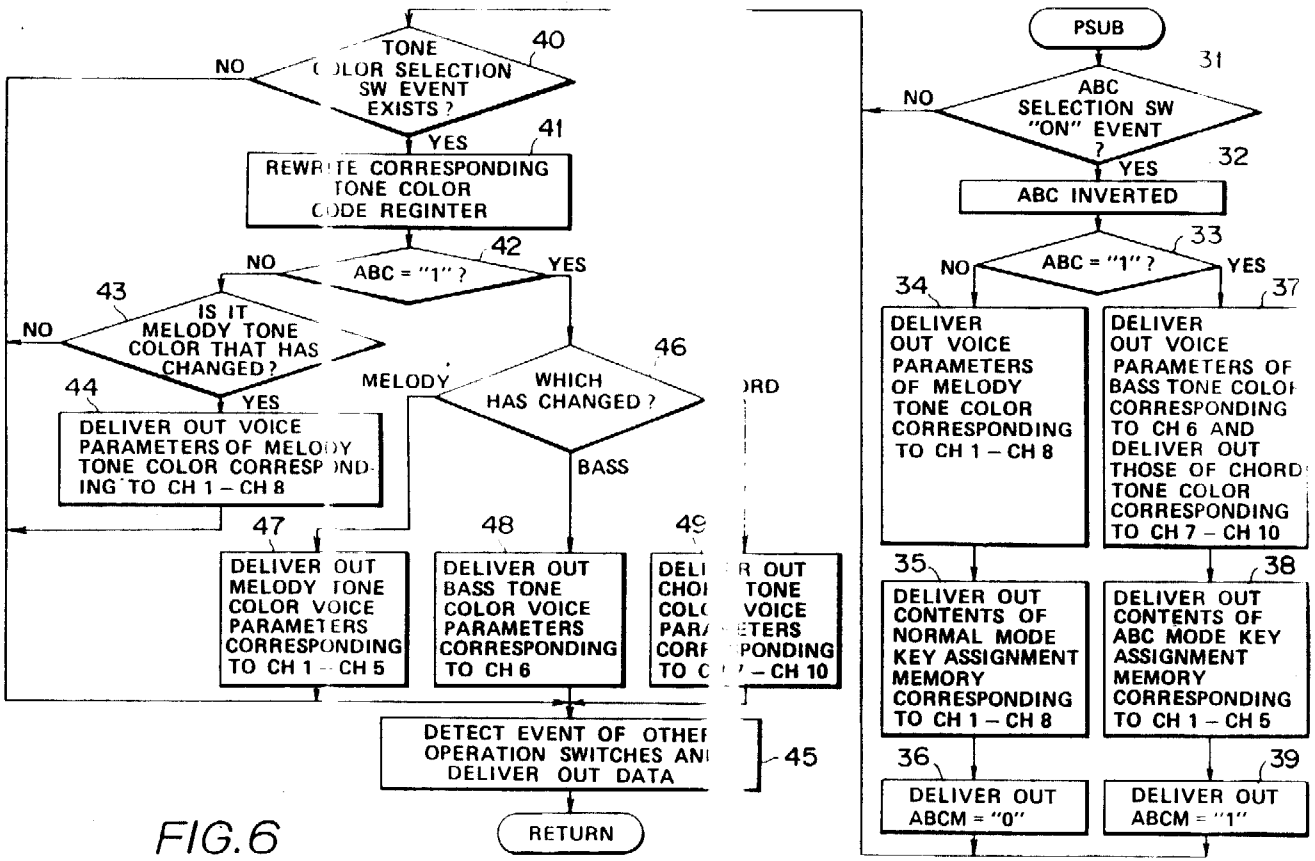
Figure 7:
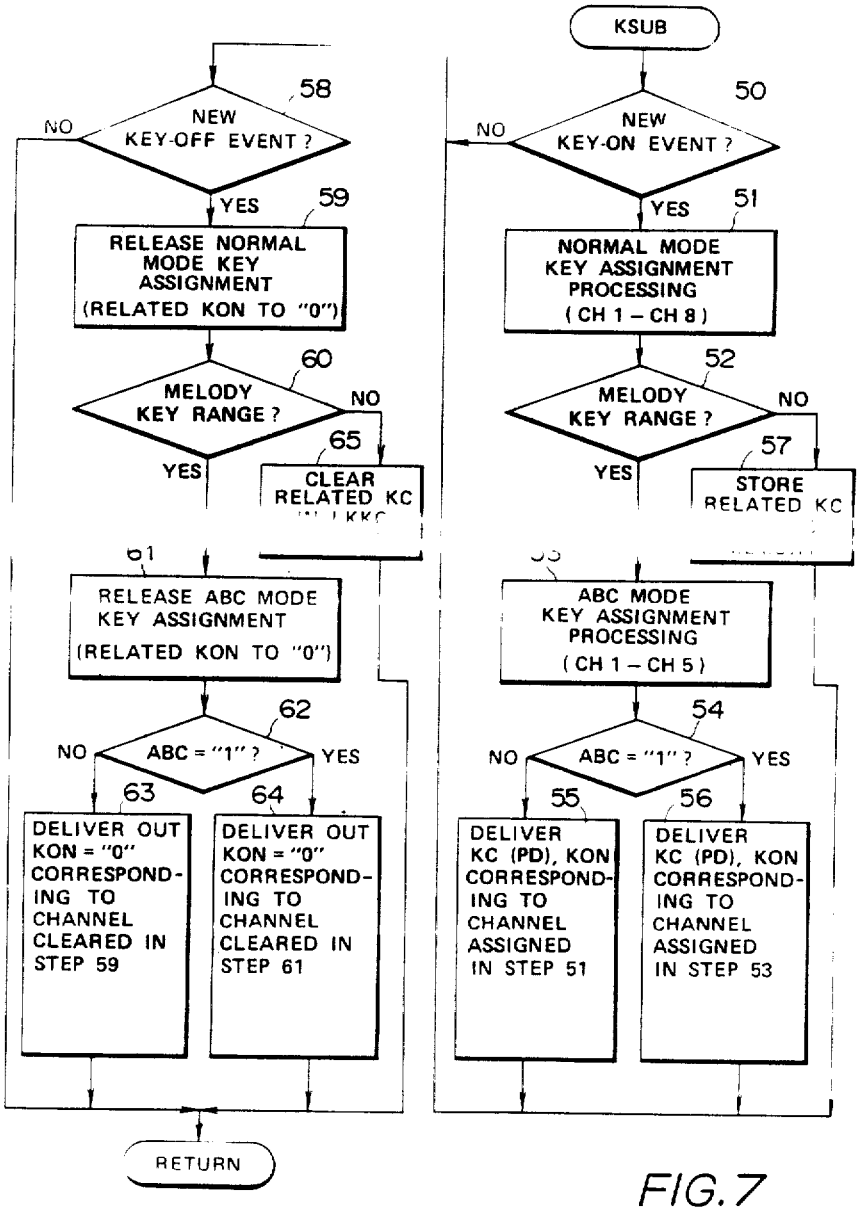
Figure 8:
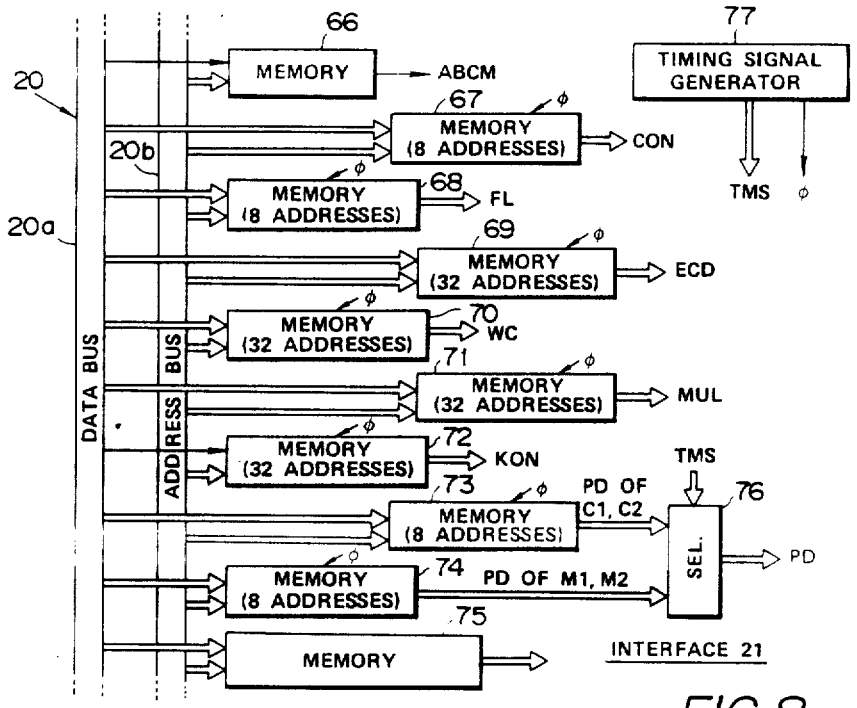
Figure 9:
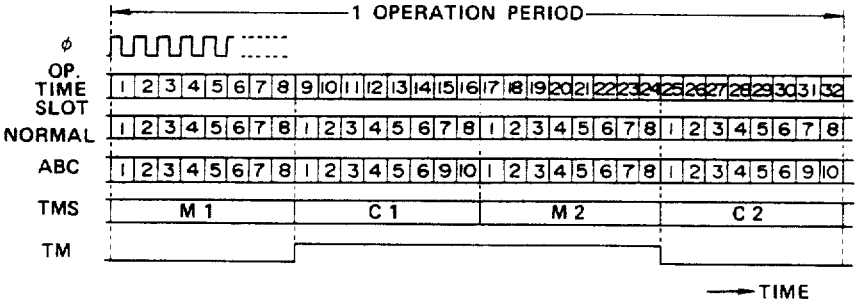
Figure 10:
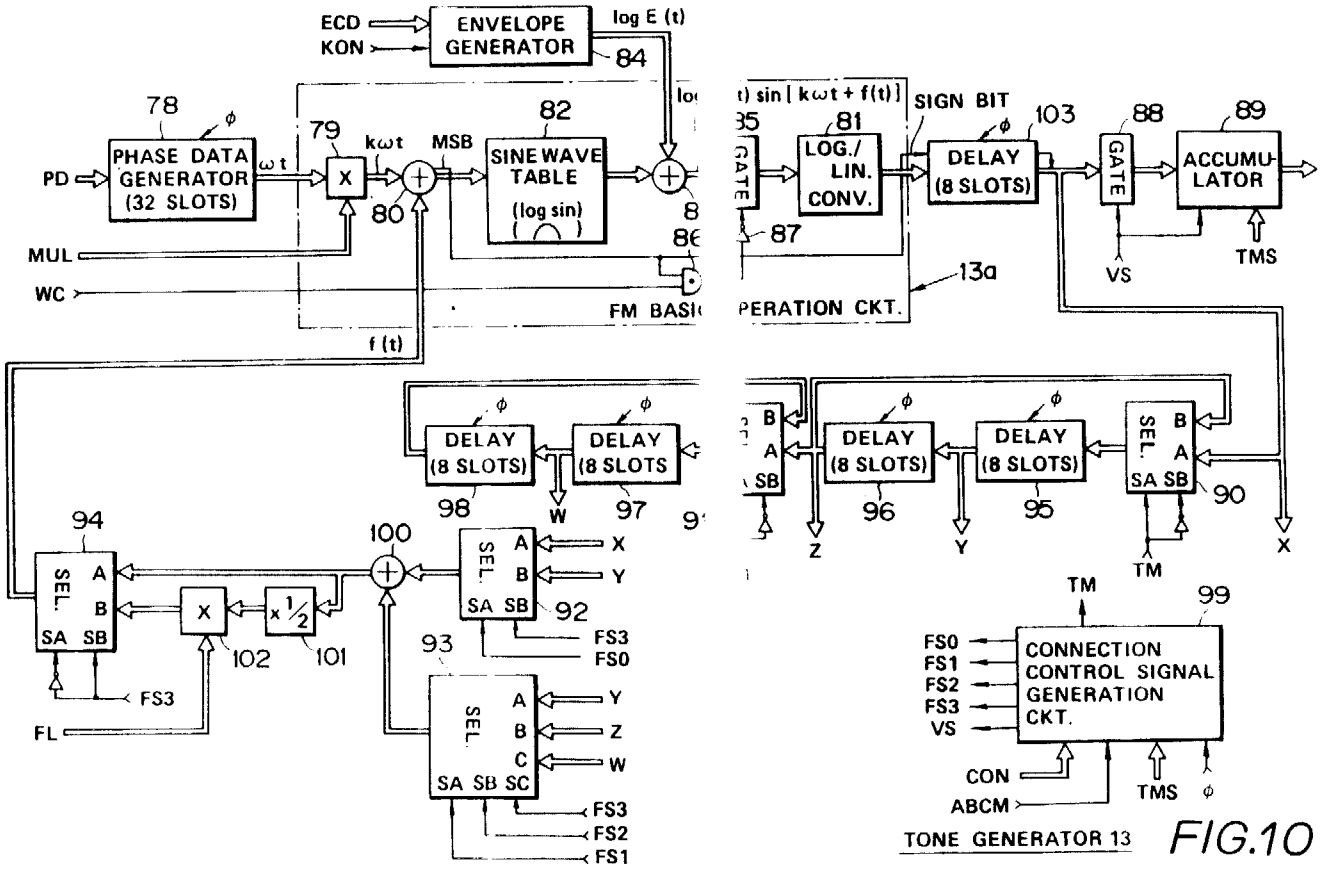
Figure 11:
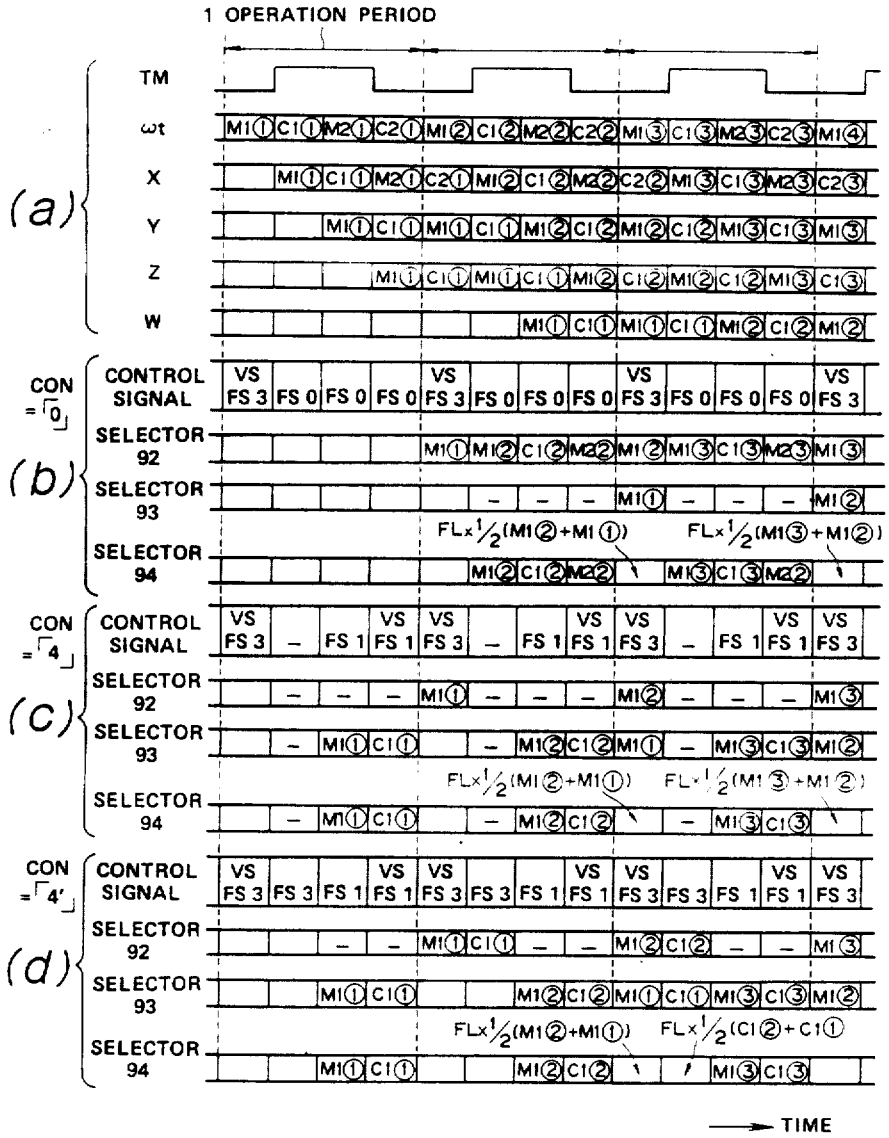
Figure 12:
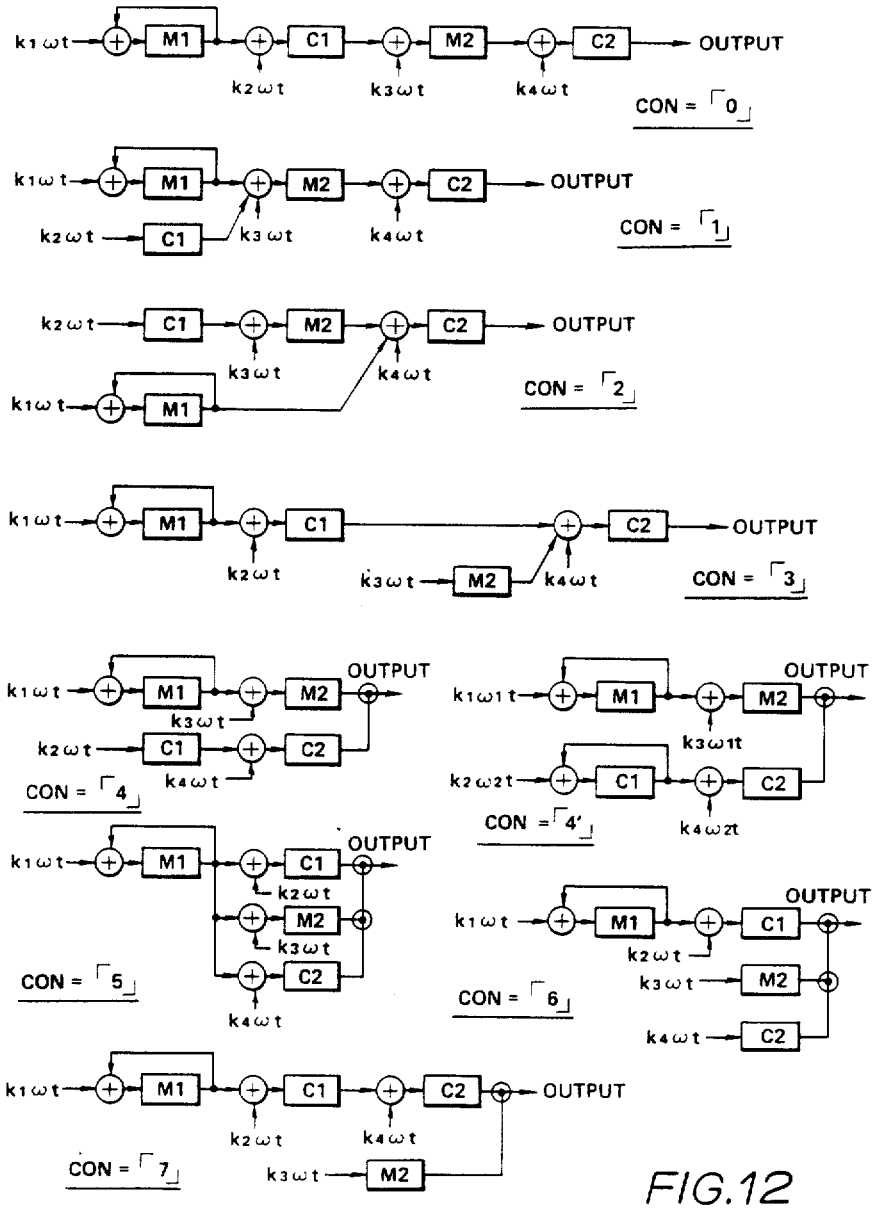

FIG. 9 is a time charge showing an example of the relationship between a plurality of time division time slots corresponding to thirty-two operation channels and a plurality of tone generation channels during a normal mode and an ABC mode corresponding to the respective time slots and also showing an example of timing signal;

FIG. 10 is a block diagram showing an example of the internal construction of a tone generator in the embodiment of FIG. 2;

FIGS. 11(*a*)–(*d*) are time charts showing an example of the operation of the circuit of FIG. 10; and FIG. 12 is a schematic block diagram showing an example of a manner of connecting operation channels in one tone generation channel.

DETAILED DESCRIPTION

The basic construction of this tone signal generation device will be described with reference to FIG. 1. Tone generation operation means 10 includes operation channels OP1–OPx of a specific number x. The respective operation channels OP1–OPx each implement a respective basic computing operation of a predetermined tone generation operation. A tone signal is generated by performing the predetermined tone generation operation employing one or more operation channels OP-1–OPx for one tone generation channel. A plurality of such tone generation channels employing one or more operation channels OP1–OPx are established by a channel establishing means 11 and simultaneous generation of plural tones thereby is made possible. The channel establishing means 11 establishes the tone generation channels in the tone generation operation means 10 in different modes in accordance with a mode (e.g., either a first mode or a second mode) selected by a mode selection means 12. In the first mode, the operation channels OP1–OPx are divided into N groups in a predetermined manner and N tone generation channels are established corresponding to the respective N groups. In the second mode, the operation channels OP1–OPx are divided into M ($N \neq M$) groups in a predetermined manner and M tone generation channels are established in correspondence to the respective M groups. In this manner, the number of tone generation channels in the tone generation operation means 10 can be switched to N or M in accordance with the selected mode. The number of modes is not limited to two.

Thus, the operation channels OP1–OPx of a specific number x are divided into N or M groups depending upon the selected mode (the number of the operation channels within each group is not necessarily equal to that of the other groups) and the tone generation channels are established according to these groups.

Accordingly, the number of tone generation channels can be changed so that the maximum number of tones which can be sounded simultaneously can be suitably changed by changing modes. In a case where a tone of a high quality is to be obtained or a complex tone color control is to be performed, i.e., where a relatively large number of operation channels need to be used for one tone generation channel, the grouping of the operation channels is established to serve this purpose and the mode is changed to one in which the number of the tone generation channels is relatively decreased. Conversely, in a case where a relatively simple tone color control is to be performed or the number of the tone generation channels is to be relatively increased, i.e., where the number of the operation channels used for one tone generation channel can be relatively small, the grouping of the operation channels is established to serve this purpose and the mode is changed to one in which the number of the tone generation channels is relatively increased.

In this manner, operation channels of a limited number can be utilized efficiently and without waste so as to increase or decrease the maximum number of tones to be sounded simultaneously as desired whereby the two requirements of improvement in tone quality and an increase in the number of tones to be sounded simultaneously can be selectively realized by using a device of a limited construction.

For example, in FIG. 1 the channel establishing means 11 includes a tone assigner means 11*a* and a parameter supply means 11*b* as shown. The tone assigner means 11*a* assigns a tone to be generated to N or M tone generation channels established in accordance with the mode selected by the mode selection means 12. In other words, the number of the tone generation channels which are subjected to the assignment by the tone assigner means 11*a* increases or decreases depending upon the mode. Information representing the tone pitches of tones which have been assigned to the respective tone generation channels is supplied to the tone generation operation means 10 in accordance with operation channel groups corresponding to the tone generation channels. The parameter supply means 11*b* supplies operation parameters for respective operation channels in the N or M tone generation channels established in accordance with the selected mode. The tone generation operation means 10 establishes operation algorithms and operation coefficients in response to the operation parameters supplied to the respective operation channels and, in accordance with these operation algorithms and operation coefficients, and also with the information representing the tone pitches of the tones assigned to the respective tone generation channels, performs the tone generation operation (computation) and generates tone signals from the respective tone generation channels.

An embodiment of the invention will now be described in detail with reference to the subsequent drawings.

FIG. 2 is a block diagram schematically showing a hardware construction, i.e., an electrical circuitry, of a keyboard type electronic musical instrument which is an embodiment of the tone signal generation device according to the invention. In this embodiment, there is provided a tone generator 13 corresponding to the above described tone generation operation means 10. In the example shown, the tone generator 13 comprises a basic operation circuit 13*a* which is preferably of the FM type, but can also be of the AM type. A plurality of operation channels of a specific number x (in the present embodiment, x is assumed to be 32) are provided in the form of time division time slots by using this basic operation circuit 13*a* on a time shared basis. For distinguishing the operation channels from the tone generation channels, the operation channels will be referred to as "operation time slots" or "operation slots" in the following description and the term "channel" will be used to designate the tone generation channels unless otherwise particularly specified.

This electronic musical instrument comprises a microcomputer section COM including a CPU (central processing unit) 14, a program ROM (read-only memory) 15 and a data and working RAM (random-access memory) 16. A key switch circuit 17 consisting of keys in a keyboard, a panel operation switch section 18 and a voice parameter memory 19 are connected to the microcomputer section COM through a bus 20. The tone generator 13 is connected also to the microcomputer section COM through an interface 21 and the bus 20. By controlling this microcomputer section COM, key switches in the key switch circuit 17 are scanned, the depression or release of keys are thereby detected and a process for assigning the generation of the tone of the depressed key to any particular one of a plurality of tone generation channels is effected. Further, by controlling the microcomputer section COM, the operation states of various switches and operation knobs in the panel operation switch section 18 are scanned and processings according to the results of the scanning (including a processing corresponding to the channel establishing means 11 in FIG. 1) are executed.

The panel operation switch section 18 comprises an automatic bass/chord performance (hereinafter sometimes referred to as ABC) selection switch 22, a melody tone color selection switch 23, a chord tone color selection switch 24, a bass tone color selection switch 25 and various other switches controlling tone color, tone level and tonal effects, and display means associated to these switches.

The ABC selection switch 22 corresponds to the mode selection means 12. When the automatic bass/-chord performance is not selected by this switch 22, the device is in a first mode (referred also as a "normal mode") and when the automatic bass/chord performance is selected by the switch 22, the device is in a second mode (referred also to as the "ABC mode"). The tone color selection switches 23, 24 and 25 are provided for respectively selecting tone colors for playing melody tones, bass tones and chord tones.

In the present embodiment, the keyboard is constructed as a single-stage keyboard. In the normal mode, all keys are used for playing melody tones whereas in the ABC mode, a key range on the higher side of a predetermined key is used as a melody key range and a key range on the lower side of the predetermined key as an accompaniment key range. In the normal mode, a tone corresponding to a key depressed in the keyboard is generated with a melody tone color imparted thereto in accordance with the key depressing operation. In the ABC mode, a tone corresponding to a key depressed in the melody key range is generated with a melody color imparted thereto in accordance with the key depressing operation while a base tone and a chord tone are formed in accordance with a key depressed in the accompaniment key range, and the tones thus imparted with the melody tone, the bass tone and the chord tone are generated in accordance with an automatic tone generation timing.

The voice parameter memory 19 consists, for example, of a ROM and stores parameters (hereinafter referred to as voice parameters) necessary for producing various tone colors selectable by the tone color selection switches 23–25 in correspondence to these tone colors. Voice parameters corresponding to the tone colors selected by the respective switches 23–25 are read out from this voice parameter memory 19. The read out voice parameters are supplied to the tone generator 13 as a part of the operation parameters.

FIG. 3 shows an example of a channel establishment in each mode. The contents of the channel establishment are programmed by the microcomputer section COM so as to become those shown in FIG. 3 in accordance with the mode selected. In the normal mode, the thirty-two operation channels i.e., operation time slots, are divided into eight groups each consisting of four operation channels. Eight tone generation channels CH1–CH8 are designated by the eight groups. An arrangement is made so that a tone signal will be generated with a melody tone color common through all of the eight tone generation channels. In the ABC mode, six tone generation channels CH1–CH6 are provided corresponding to six groups each consisting of four operation channels and four tone generation channels CH7–CH10 are provided in corespondence to four groups each consisting of two operation channels. In this case, five of the tone generation channels CH1–CH5 are used for generating tones having the melody tone color and four of the tone generation channels CH7–CH10 are used for generating tones having the chord tone color. In the foregoing manner, eight tone generation channels are used in the normal mode whereas ten tone generation channels are used in the ABC mode. Alternatively stated, the groups for the tone generation channels CH7 and CH8 each consisting of four operation channels (7, 15, 23, 31) and (8, 16, 24, 32) are respectively divided in half thereby respectively providing four groups each consisting of two operation channels. As a result, four tone generation channels CH7–CH10 are provided in correspondence to the four groups each consisting of two operation channels (7,23), (8,24), (15,31) and (16,32).

In accordance with the differences in the contents of the channel establishment, depending upon the mode, contents of the key assigning processings in the microcomputer section COM become different depending upon the mode and the manner of supplying the voice parameters becomes also different depending upon the mode. Data and voice parameters corresponding to the tone pitches of tones assigned to the tone generation channels CH1–CH8 or CH1–CH10 which vary depending upon the mode are supplied from the microcomputer section COM to the tone generator 13 through the interface 21. The tone generator 13 performs an eight-channel type of ten-channel type tone generation operation in accordance with the data supplied from the microcomputer section COM. The generated tone signal is supplied to a sound system 26.

FIG. 4 shows an example of a memory structure in the data and working RAM 16. An ABC register stores a signal indicating whether the selected mode is the ABC mode or not. When this signal is "1", the selected mode is the ABC mode and when the signal is "0", the selected mode is the normal mode. Contents of this ABC register are switched by operation of the ABC selection switch 22. A UKTC register stores data (a melody tone color code UKTC) representing a melody tone color selected by the melody tone color selection switch 23. An LKTC register stores data (a chord tone color code LKTC) representing a chord tone color selected by the chord tone color selection switch 24. A PKTC register stores data (a bass tone color code PKTC) representing a bass tone color selected by the bass tone color selection switch 25. An LKKC memory stores a key code of a key depressed in the accompaniment key range (an accompaniment key range code LKKC). A normal mode key assignment memory 27 stores a key code KC and a key-on signal KON of a key which has been assigned to one of the tone generation channels CH1–CH8 for the melody tone color in the normal mode. An ABC mode key assignment memory 28 stores a key code KC and a key-on signal KON of a key which has been assigned to one of the tone generation channels CH1–CH5 for the melody tone color in the ABC mode.

An example of the program executed by the microcomputer section COM will now be described. FIG. 5 schematically shows the main routine of the program. In "panel operation switches scanning processing", respective switches in the panel operation switch section 18 are scanned and a predetermined processing is executed in accordance with results of the scanning. In this processing, a panel scanning subroutine PSUB as shown in FIG. 6 is executed. In "key scanning processing", respective keys in the key switch circuit 17 are scanned and thereupon a processing for assigning keys to the tone generation channels for the melody tone color is executed. In this processing, a key scanning subroutine KSUB as shown in FIG. 7 is executed. Nextly, in step 29, whether contents of the ABC register are "1" (i.e., the ABC mode) or not is examined. If the result is NO, the processing returns to "panel operation switches scanning processing" whereas if the result is YES, the processing proceeds to step 30. In step 30, a key code KC of an automatic bass tone and a key code KC of an automatic chord tone are produced in accordance with the key code KC of the depressed key. The key code KC of the automatic bass tone is assigned to the tone generation channel CH6 for the automatic bass tone and the key code KC of the automatic chord tone is assigned to the tone generation channels CH7–CH10 for the automatic chord tones. The key code KC assigned to the respective channels CH6–CH10 are delivered out with the key-on signal KON and supplied to the tone generator 13 through the interface 21. In this case, the key code KC is delivered out after being converted to corresponding pitch data PD. The pitch data PD is numerical data corresponding to a tone pitch frequency known as the frequency number. The key-on signal KON should preferably be turned to "1" in accordance with the tone generation timing of the automatic bass tone and the automatic chord tone.

The panel scanning subroutine will be described with reference to FIG. 6. In the first step 31, whether there has been an ON event in the ABC selection switch 22 or not is examined. If the result is YES, the contents of the ABC register are inverted (step 32). In step 33, whether the contents of the ABC register are "1" (i.e., the ABC mode has been selected) or not is examined. If the result is NO, i.e., the mode is the normal mode, the processing proceeds to step 34 in which voice parameters of a melody tone color are provided in correspondence to the channels CH1–CH8 in the normal mode. More specifically, voice parameters are read out from the voice parameter memory 19 in accordance with the melody tone color code stored in the UKTC register and these voice parameters are delivered out in correspondence to the respective channels CH1–CH8 or the four operation channels of the respective channels CH1–CH8. In next step 35, contents of assignment (the key code KC and the key-on signal KON) of the respective channels CH1–CH8 stored in the normal mode key assignment memory 27 are delivered out. In this case also, the key code KC is delivered out after being converted to corresponding pitch data PD. In next step 36, a signal "0" is delivered out as an ABC mode signal ABCM. The voice parameters, pitch data PD, key-on signal KON and ABC mode signal ABCM delivered out in steps 34, 35 and 36 are supplied to the tone generator 13 through the interface 21. The route of step 34 through 36 is taken when the mode has been changed from the ABC mode to the normal mode (i.e., step 31 is YES and step 33 is NO). In this case, the state of channel setting changes as a result of the switching of the mode so that the state of tone generation in the tone generator 13 must also be changed. For this purpose, the processings of steps 34–36 are executed for supplying necessary data in the normal mode to the tone generator 13.

When the mode has been switched from the normal mode to the ABC mode, contents of the ABC register are "1" and the processing proceeds from YES in step 33 to step 37. In step 37, the voice parameter of the bass tone color is delivered out in correspondence to the channel CH6 in the ABC mode and the voice parameters of the chord tone color are delivered out in correspondence to the channels CH7–CH10 in the ABC mode. More specifically, voice parameters are read out from the voice parameter memory 19 in accordance with the chord tone color code stored in the LKTC register and are delivered out in correspondence to the respective channels CH1–CH10 or the two operation channels of the channels CH1–CH10. Likewise, voice parameters are read out from the voice parameter memory 19 in accordance with the bass tone color code stored in the PKTC register and are delivered out in correspondence to the channel CH6 or the four operation channels of this channel. The voice parameters of the melody tone color are not delivered out in correspondence to the channels CH1–CH5 because these channels CH1–CH5 are for the same melody tone color in the ABC mode as in the normal mode so that no change is required.

In next step 38, contents assigned to the melody tone color channels CH1–CH5 in the ABC mode stored in the ABC mode assignment memory 28 (the key code KC and the key-on signal KON) are delivered out. In this case also, the key code KC is delivered out after being converted to pitch data PD. The contents assigned to the channels CH6–CH10 for the automatic bass/chord performance are not delivered out because these contents are delivered out in step 30 (FIG. 5) of the main routine. In next step 39, a signal "1" is delivered out as the ABC mode signal ABCM.

Data delivered out in steps 37–39 are supplied to the tone generator 13 through the interface 21 in the same manner as described previously. These steps 37–39 are executed when the mode has been switched from the normal mode to the ABC mode (i.e., when step 31 is YES and step 33 is NO) because, for the same reason as was previously described, the state of channel setting changes with the switching of the mode so that the state of tone generation in the tone generator 13 must also be changed.

In a case where an ON event of the ABC selection switch is not detected, step 31 is NO and the processing advances to step 40 skipping over the above described steps 32–39.

In step 40, whether the tone color selection states in the tone color selection switches 23–25 have been changed or not is examined. If the result is YES, the processing proceeds to step 41 in which contents of the tone color code registers (UKTC, LKTC and PKTC) corresponding to the switches 23–25 in which the tone color selection state have been changed are rewritten. In step 42, whether contents of the ABC register is "1" or not is examined. If the result is NO, the processing proceeds to step 43 in which whether the tone color which has changed are the melody tone color or not is examined. In the normal mode, no tone color but the melody tone color is used so that the processing jumps to step 45 passing NO of step 43. If the melody tone color has changed, the processing proceeds to step 44 in which voice parameters of new melody tone color after the change are delivered out in correspondence to the respective channels CH1–CH8 in the normal mode. In this step, delivery of the voice parameters is effected in the same manner as in the processing in step 34.

In the ABC mode, step 42 is YES and the processing proceeds to step 46. In this step 42, it is examined which of the melody tone color, bass tone color and chord tone color is the tone color which has changed this time. If the melody tone color has changed, voice parameters of the new melody tone color after the change are delivered out in correspondence to the melody tone color channels CH1–CH5 in the ABC mode (step 47). If the bass tone color has changed, voice parameter of the new bass tone color after the change is delivered out in correspondence to the bass tone color channel CH6 in the ABC mode (step 48). If the chord tone color has changed, voice parameters of the chord tone color are delivered out in correspondence to the chord tone color channels CH7–CH10 in the ABC mode (step 49). The voice parameters delivered out in steps 44 and 47–49 are supplied to the tone generator 13 through the interface 21.

Lastly, in step 45, change (event) in the operation states of other switches and operation knobs (e.g., tone level operation knob, effect selection switch and rhythm selection switch) in the panel operation switch section is detected and data responsive to the detection is supplied to the tone generator 13 through the interface 21. In a case where events in plural ones of the tone color selection switches 23–25 have simultaneously been detected, the processings in steps 41–49 are repeatedly executed.

The key scanning subroutine KSUB will be described with reference to FIG. 7. In step 50, whether there has been a new key-on event (i.e., depression of a new key) or not is examined. If the result is YES, a new key-on event processing consisting of steps 51–57 is executed. Upon completion of the new key-on event processing or in case there has been no new key-on event, the processing proceeds to step 58. In step 58, whether there has been a new key-off event (i.e., new release of a depressed key) or not is examined. If the result is YES, a new key-off event processing consisting of steps 59–65 is executed.

In the new key-off event processing, a normal mode key assignment processing is performed in step 51. This processing is one in which a newly depressed key is assigned to any of the eight tone generation channels CH1–CH8. Upon determination of a channel to which the new key is to be depressed, the key code KC and the key-on signal KON concerning the newly depressed key are stored in the normal mode key assignment memory 27 in correspondence to this channel. In next step 52, whether the newly depressed key belongs to the melody key range or not is examined. If the result is YES, the processing proceeds to step 53 in which an ABC mode key assignment processing is effected. This is a processing in which a newly depressed key in the melody key range is assigned to any of the five tone generation channels CH1–CH5 for the melody tone color in the ABC mode. Upon determination of a channel to which the newly depressed key is to be assigned, the key code KC and the key-on signal KON concerning the newly depressed key are stored in the ABC mode assignment memory 28 in correspondence to this channel.

In step 54, whether the mode is ABC mode or not is examined. If the result is NO (i.e., normal mode), the processing proceeds to step 55 in which the key code KC and the key-on signal KON of the newly depressed key are delivered out in correspondence to the channel assigned in step 51. If the result is YES (i.e., ABC mode), the processing proceeds to step 56 in which the key code KC and the key-on signal KON of the newly depressed key are delivered out in correspondence to the channel assigned in step 53. In the same manner as was previously described, the key code KC is delivered out in steps 55 and 56 after being converted to pitch data PD. The contents of the delivered out key-on signal KON are "1" indicating depression of the key. Alternatively, steps 55 and 56 may be executed only when there has been change in the contents of the key assignment as a result of the key assignment processing in steps 51 and 53. For example, even when there has been a new key-on event, it will occur that the newly depressed key is not assigned to any of the tone generation channels depending upon the conditions of assignment in steps 51 and 53. In such a case, steps 55 and 56 need not be executed.

If the newly depressed key belongs to the accompaniment key range, step 52 is NO and the processing proceeds to step 57. In this step, the key code KC of the newly depressed key is stored in an LKKC memory. The LKKC memory can store a plurality of key codes. In response to the key code KC of the accompaniment key range, the processing in step 30 is executed. Instead of storing an unlimited number of key codes KC of the depressed keys in the LKKC memory, a predetermined number of key codes KC only may be stored in a predetermined priority order.

The flow of processings of steps 59–65 in the new key-off event processing is the same as that of steps 51–57 in the new key-on event processing and the judgements made in steps 60 and 62 are the same as those made in steps 52 and 54. However, processings in steps 59, 61, 63, 64 and 65 are somewhat different from those in corresponding steps 51, 53, 55, 56 and 57. In step 59, the channel to which the key of the new key-off event is assigned is detected from among the channels CH1–CH8 for the normal mode whereupon contents of the key-on signal KON concerning this channel stored in the normal mode assignment memory 27 are cleared to "0". In step 61, the channel to which the key of the new key-off event is assigned is detected from among the channels CH1–CH5 for the melody tone color in the ABC mode whereupon contents of the key-on signal KON concerning this channel stored in the ABC mode assignment memory 28 are cleared to "0". In steps 63 and 64, the key-on signal "0" is produced for the channels in which the key-on signal KON has been cleared to "0" in the preceding steps 59 and 61 (i.e., the channel to which the newly released key has been assigned). In step 65, the key code KC of the key concerning the new key-off event is cleared in the LKKC memory.

Referring now to FIG. 8, an example of the interface 21 will be described.

The interface 21 comprises memories 66–75 which store various data supplied from the microcomputer section COM through the bus 20 and output the stored data at timings corresponding to time division timings of the respective operation channels in the tone generator 13. The memories 69–72 which need to store data separately for each of thirty-two operation channels respectively have thirty-two memory positions (addresses). The memories 67, 68, 73 and 74 which need to store data separately for each of eight (or ten) operation channels CH1–CH8 (or CH1–CH10) respectively have eight memory positions (addresses). As is known in the art, the bus 20 includes data bus **20*a* and address bus 20*b*. Address data indicating a specific memory (any of the memories 66–75) in which data transmitted through the data bus 20*a* should be stored and a specific address (i.e., operation channel number or tone generation channel number) at which the data should be stored in the specific memory is supplied through the address bus 20*b*. The memories 66–75 decode address signals supplied thereto through the address bus 20*b* and, when data should be stored in them, receive data on the data bus 20*a*** and store the received data in the memory position corresponding to the operation channel or tone generation channel designated by the address signal.

The ABCM memory 66 stores the ABC mode signal ABCM produced in steps 36 and 39 in FIG. 6.

The memories 67–71 store the voice parameters produced in steps 34, 37, 44, 47–49 in FIG. 6. The memory 67 stores an operation connection parameter CON for each of the tone generation channels CH1–CH8 (or CH1–CH10). This operation connection parameter CON designates the mode of connection (or operation algorithm) of plural operation channels in one tone generation channel. The memory 68 stores self feedback level data FL for each of the tone generation channels CH1–CH8 (or CH1–CH10). The self feedback level data FL is coefficient data for setting a feedback amount in a case where, in the basic FM operation performed in one operation channel, a signal which has been modulated in the channel is fed back to the same channel as a modulating signal.

The memory 69 stores envelope control data ECD for each of the operation channels. The envelope control data ECD is data for setting and controlling an envelope signal corresponding to modulation index in the FM operation or an envelope signal corresponding to amplitude coefficient in the FM operation.

The memory 70 stores waveshape change data WC for each of the operation channels. The waveshape change data WC is data designating change in the waveshape of a waveshape signal used in the FM operation in a specified phase section. If, for example, the waveshape signal is a sinusoidal wave, the waveshape level is cut to a 0 level in the phase section of 180 degrees–360 degrees whereby the waveshape is changed to a half-wave rectified waveshape. By this operation, harmonic components increase in the changed waveshape signal with a result that a complicated tone color control can be made with a relatively simple FM operation. This waveshape change operation therefore is particularly advantageous in a case where there are only few operation channels available for generation of a tone.

The memory 71 stores frequency ratio setting data MUL for each of the operation channels. The frequency ratio setting data MUL is coefficient data for setting the frequency of a carrier or a modulating wave in the FM operation at a frequency which is integer multiple (or may be non-integer multiple) of the tone pitch frequency designated by the pitch data PD.

The memories 69–71 each have thirty-two addresses corresponding to the number of the operation channels so that they can set voice parameters independently for the respective operation channels. The memories 67 and 68 each have eight addresses corresponding to the number of the tone generation channels in the normal mode and not ten addresses corresponding to the number of the tone generation channels in the ABC mode. This is because corresponding voice parameters are shared commonly between the tone generation channels CH7 and CH9 and also between the channels CH8 and CH10 for the ABC mode.

The memory 72 stores the key-on signal KON produced in steps 35 and 38 in FIG. 6 and steps 55, 56, 63 and 64 in FIG. 7 for each of the operation channels. The key-on signal KON may be stored for each of the tone generation channels but, considering that the number of the tone generation channels in the ABC mode is ten, the key-on signal KON is stored for the respective thirty-two operation channels. Accordingly, the key-on signal KON is not stored independently for each of the operation channels but the key-on signal of the same contents is stored in the same operation channel group corresponding to each of the tone generation channels CH1–CH8 or CH1–CH10.

The memory 73 stores the pitch data PD of a carrier used in the FM operation. The memory 74 stores the pitch data PD of a modulating wave used in the FM operation. These pitch data PD are produced in steps 35, 38, 55 and 56 in FIGS. 6 and 7. In the normal mode, the same pitch data PD is stored at the addresses corresponding to the same tone generation channel in the memories 73 and 74. In a case where a non-harmonic tone color is to be realized by causing the pitches of the carrier and the modulating wave to differ slightly from each other, values of the pitch data PD stored at the addresses corresponding to the same tone generation channels in the memories 73 and 74 may be made slightly different from each other. In the ABC mode, pitch data PD of tones assigned to the channels CH1–CH6 are stored at addresses corresponding to these channels CH1–CH6 in the memories 73 and 74. In the remaining two addresses of the memory 73 are stored pitch data PD of a tone assigned to the channel CH9 and pitch data PD of a tone assigned to the channel CH10. In the remaining two addresses of the memory 74 are stored pitch data PD of tones assigned to the channels CH7 and CH8.

The memory 75 stores other data and supplies it to the tone generator 13.

The respective memories 67–74 deliver out data stored at their respective addresses sequentially in response to clock pulse $\phi$ establishing the time division time slot of the operation channels. Outputs of the memories 66–72 and 75 are supplied to the tone generator 13. Outputs of the memories 73 and 74 are supplied to the tone generator 13 through a selector 76. The selector 76 selects an output of the memory 73 or 74 in response to a carrier/modulating wave operation timing signal TMS and supplies the selected output to the tone generator 13.

FIG. 9 shows time division time slots for the thirty-two operation channels set by the clock pulse $\phi$. The time slot numbers 1–32 shown correspond to the operation channel numbers 1–32 shown in FIG. 3. In the line of the normal channel, the numbers 1–8 of the tone generation channels CH1–CH8 in the normal mode are shown in corresponding relation to the time slots of the operation channels constituting the tone generation channels. In the line of the ABC channel, the numbers 1–10 of the tone generation channels CH1–CH10 in the ABC mode are shown in corresponding relation to the time slots of the operation channels constituting the tone generation channels. One operation period consists of thirty-two time slots so that in the normal mode the operation time slot of each of the tone generation channels CH1–CH8 arrives with a period of eight time slots. In the first eight-slot period, operation concerning the first modulating wave is effected in each channel and this first eight-slot period will be hereinafter referred to as "first modulator operation slot M1". In the next eight-slot period, operation concerning the first carrier is effected in each channel and this period will be referred to as "first carrier operation slot C1". In the third eight-slot period, operation concerning the second modulating wave is effected in each channel and this period will be referred to as "second modulator operation slot M2". In the last eight-slot period, operation concerning the second carrier is effected in each channel and this period will be referred to as "second carrier operation slot C2". In the foregoing manner, in the normal mode, four operation time slots are allotted for each tone generation channel with an eight-slot period and one tone signal is generated by the FM operation using these four operation time slots.

In the ABC mode, four operation time slots are allotted for each of the melody tone color tone generation channels CH1–CH5 and the bass tone color tone generation channel CH6 with an eight-slot period. As to the melody tone color and the bass tone color, therefore, one tone signal is generated by the FM operation using four operation time slots in the same manner as described above. On the other hand, as to the tone generation channels CH1–CH10 for the chord tone color, two time slots are allotted within one operation period for each of these tone generation channels with a sixteen-slot period. Accordingly, as to the chord tone color, one tone signal is generated by the FM operation using two operation time slots.

The memories 67–72 provide, on a time shared basis, voice parameters CON–MUL and the key-on signal KON corresponding to the respective operation channels for each tone generation channel at a predetermined timing as shown in FIG. 9 depending upon which of the normal mode and the ABC mode has been selected.

The carrier/modulating wave operation timing signal TMS assumes values representing the respective operation slots M1, C1, M2 and C2 according to the timing of the above described eight-slot period. The selector 76 selects the pitch data PD for eight channels (CH1–CH8 in the normal mode and CH1–CH8 in the ABC mode) read out from the memory 74 when the signal TMS designates the slot M1. The selector 76 selects the pitch data PD for eight channels (CH1–CH8 in the normal mode and CH1–CH6, CH9 and CH10 in the ABC mode) when the signal TMS designates the slot C1. The selector 76 selects the pitch data PD read out from the memory 74 when the signal TMS designates the slot M2 and selects the pitch data PD read out from the memory 73 when the signal TMS designates the slot C2. Accordingly, the pitch data PD provided by the selector 76 is also data obtained by time-division multiplexing data corresponding to the respective operation channels for each of the tone generation channels at a timing as shown in FIG. 9 depending upon which of the normal mode and the ABC mode has been selected.

Referring now to FIG. 10, an example of the tone generator 13 will be described.

An FM basic operation circuit 13*a* executes the FM basic operation. This basic operation is expressed, for example, by the equation $E(t)\sin\{\omega t+f(t)\}$ where $\omega t$ represents phase data changing with time, f(t) modulating signal and E(t) amplitude coefficient, respectively. This FM basic operation circuit 13*a* is used on a time shared basis in thirty-two time slots for one operation period whereby FM operations for thirty-two operation channels are respectively performed.

The pitch data PD produced by the selector 76 in FIG. 8 is supplied to a phase data generator 78 in which phase data $\omega t$ is generated responsive to the pitch data PD. The phase data generator 78 generates the phase data by, for example, accumulating on a time shared basis respective pitch data PD for thirty-two slots supplied in the respective time division time slots on a time shared basis and outputting phase data $\omega t$ derived as a result of the accumulation for thirty-two slots on a time shared basis. This phase data $\omega t$ is supplied to a multiplier 79 in the FM basic operation circuit 13*a*.

The multiplier 79 multiplies the frequency ratio setting data MUL supplied from the memory 71 in FIG. 8 with the phase data $\omega t$ thereby controlling the frequency of the carrier or the modulating wave. Since the data MUL normally is a number which is n-th power of 2 such as 1, 2 and 4, the multiplier 79 can be constructed of a simple shift circuit.

The frequency-controlled phase data $k\omega t$ (where k is a coefficient corresponding to the value of the data MUL) provided by the multiplier 79 is applied to one input of an adder 80. To the other input of the adder 80 is applied the output signal of a selector 94 as the modulating signal f(t). Phase data which has been phase modulated in response to the modulating signal f(t) therefore is provided by the adder 80. Data for all bits other than the most significant bit MSB is applied to an address input of a sinusoidal wave table 82. The sinusoidal wave table 82 stores sample point amplitude data of a half-period waveshape of a sinusoidal wave in logarithms. Since the phase data applied to the address input is data provided by excluding the most significant bit MSB from the original phase data, it changes with a period which is half the original repetition period. Accordingly, the half period waveshape of the sinusoidal wave is repeatedly read out from the sinusoidal wave table 82 in response to phase data of the half period cycle.

The waveshape data read out from the sinusoidal wave table 82 is applied to an adder 83 in which the data is added with envelope level data supplied as the amplitude coefficient E(t) from an envelope generator 84. This envelope level data also is data expressed in logarithms. Since addition of logarithms is equivalent to multiplication of their antilogarithms, the adder 83 substantially effects multiplication of the waveshape sample point amplitude data by the amplitude coefficient E(t). The envelope generator 84 generates, responsive to the envelope control data ECD and the key-on signal KON supplied from the memories 69 and 72 in FIG. 8, envelope level data having predetermined envelope characteristics from the start of generation of a tone to the end thereof for each operation slot on a time shared basis. The function of this envelope level data differs depending upon the operation slot, that is, the envelope level data functions as modulation index in the operation slot in which the modulating signal is generated whereas it functions as amplitude coefficient in the operation slot in which the carrier signal is generated.

The output of the adder 83 is applied to a gate 85. The waveshape change data WC produced by the memory 70 and the most significant bit MSB of the phase data provided by the adder 80 are applied to an AND gate 86 and a signal obtained by inverting the output of the AND gate 86 by an inverter 87 is applied to the control input of the gate 85. The most significant bit MSB of the phase data $k\omega t$ is "0" in a phase section between 0–180 degrees and "1" in a phase section between 180–360 degrees. The waveshape change data WC is "1" when it designates change in the waveshape and otherwise "0". If the waveshape change data WC is "0", the output of the AND gate 86 is "0" and the output of the inverter 87 is "1" so that the gate 85 is always open regardless of the phase section. If the waveshape change data WC is "1", the output of the AND gate 86 becomes "1" in the phase section of 180–360 degrees and the gate 85 therefore is closed. Accordingly, outputting of the sinusoidal wave is prohibited in the phase section of 180–360 degrees and a waveshape signal of a half-wave rectified waveshape is provided on the output side of the gate 85. Thus, the waveshape is changed by the waveshape change data WC.

The output of the gate 85 is applied to a logarithm/-linear converter 81 in which the logarithmic data is converted to data of linear expression. The data of the most significant bit MSB of the phase data provided by the adder 80 is added to the output signal of the logarithm/linear converter 81 as a sign bit designating positive or negative polarity of the data. The MSB data is "1" in the phase section of 180–360 degrees, representing the negative polarity. By adding of this sign bit, the two half-period waveshapes of the sinusoidal waves read out from the sinusoidal wave table 82 are corrected to a complete full period waveshape.

A signal obtained by adding the sign bit to the output signal of the logarithm/linear converter 81 is the output signal of the FM basic operation circuit 13*a*. This signal is applied to a delay circuit 103 which delays the signal by eight time slots. The output of the delay circuit 103 is applied to an accumulator 89 through a gate 88 and also to an A input of a selector 90.

The accumulator 89 accumulates (adds), responsive to a control signal VS, results of operation in the operation time slots concerning the same tone generation channel within one operation period (i.e., thirty-two time slots) to obtain the tone signal in that tone generation channel and also adds tone signals of the respective tone generation channels together. Alternatively stated, the accumulator 89 obtains a tone signal by adding operation results for respective terms in the multi-term FM operation together and also adds plural tone signals together. The addition control signal VS is supplied from a connection control signal generation circuit 99. This signal VS is turned to "1" at a time slot in which the addition is to be effected and thereupon opens the gate 88 to supply data to the accumulator 89 and also the addition order to the accumulator 89.

A circuit comprising selectors 90–94 and delay circuits 95–98 effecting delay of eight time slots is provided for establishing the mode of connection (i.e., operation algorithm) of the respective operation channels within one tone generation channel. This mode of connection is switched by connection control signals FS0–FS3 generated by the connection control signal generation circuit 99. To this circuit 99 are applied the ABC mode signal ABCM and the operation connection parameter CON provided by the memories 66 and 67 in FIG. 3 and also the timing signal TMS and the clock pulse $\phi$. Responsive to the signals ABCM, CON and TMS, the connection control signal generation circuit 99 generates the connection control signals FS0–FS3 and the addition control signal VS in a predetermined pattern to be described later. The circuit 99 generates also a timing signal TM which is "1" in the slots C1 and M2 and "0" in the slots C2 and M1 as shown in FIG. 9 in response to the signal TMS.

The delay circuits 103 and 95–98 and the selectors 90 and 91 function to delay the output signal of the basic operation circuit 13*a* in various patterns. The output of the selector 90 is applied to the delay circuit 96, the output of the delay circuit 95 is applied to the delay circuit 96 and the output of the delay circuit 96 in turn is applied to a B input of the selector 90 and an A input of the selector 91. The output of the selector 91 is delayed by a total of sixteen slots by the delay circuits 97 and 98 and applied to the B input of the selector 91 itself. The selectors 90 and 91 select the A input when the timing signal TM is "1" and the B input when the timing signal TM is "0".

To the A input of the selector 92 is applied an output signal X of the delay circuit 103 and to the B input of the selector 92 is applied an output signal Y of the delay circuit 95. This selector 92 selects the A input when the connection control signal FS0 is "1" and the B input when the signal FS3 is "1". To the A input of the selector 93 is applied the output signal Y of the delay circuit 95, to the B input of the selector 93 is applied an output signal Z of the delay circuit 96 and to the C input of the selector 93 is applied an output signal W of the delay circuit 97. This selector 93 selects the A input when the connection control signal FS1 is "1", the B input when the signal FS2 is "1" and the C input when the signal FS3 is "1".

The outputs of the selectors 92 and 93 are added together by an adder 100 and the result of addition is applied to the A input of the selector 94 and also to a ½ shift circuit 101. The output of the ½ shift circuit 101 is supplied to a multiplier 102 in which it is multiplied with feedback level data FL supplied from the memory 68 in FIG. 8. The selector 94 selects the B input when the connection control signal FS3 is "1" and the A input when the signal FS3 is "0". The output signal of the selector 94 is applied to the adder 80 in the FM basic operation circuit 13*a* as the modulating signal f(t).

FIG. 11(*a*) shows an example of operation slots of the output signals X, Y, Z and W. As reference timing, the operation slot of the phase data $\omega t$ which is the input signal to the FM basic operation circuit 13*a* is shown. For convenience of illustration, operation slots for one tone generation channel only are shown in an enlarged scale in FIGS. 11(*a*)–(*d*) as if the slot width was eight slots. Signals corresponding to the four operation slots in one tone generation channel are distinguished by reference characters M1, C1, M2 and C2 and the operation period of each signal is designated by affixing reference characters 1, 2 etc. For example, M1 1 represents a signal of the operation slot M1 in a certain operation period and M1 2 represents a signal of the same operation slot M1 one operation period later. It is assumed that there is no time delay in the signal in the FM basic operation circuit 13*a* so that the result of the operation is provided at the same timing as the input signal $\omega t$.

Since the signal X is one obtained by delaying the FM operation output by eight slots by the delay circuit 103, the signal X is delayed by eight slots from the timing of the input signal $\omega t$ so that all results of operation in the four operation slots M1–C2 appear in the signal X. Since results of operation in the operation slots M1 and C1 appear in the signal X in response to "1" of the timing signal TM, these results are selected by the selector 90 and provided as the signal Y after being delayed by eight slots by the delay circuit 95. The signal Z is provided by delaying this signal Y by eight slots further. When the timing signal TM is "0", results of operation in the operation slots M1 and C1 appear as the signal Z after being delayed so that the results are selected by the selector 90 and supplied to the delay circuit 95 again. In this manner, the results of operation in the operation slots M1 and C1 repeatedly appear twice as the signal Y. In the signal Z, the same contents as the signal Y appear after being delayed by eight slots. The circuit consisting of the selector 91 and the delay circuits 97 and 98 functions in the same manner as the circuit consisting of the selector 90 and the delay circuits 95 and 96 with a result that the signal W which is a signal obtained by delaying the signal Z by twenty-four slots is provided by the delay circuit 97.

In FIG. 11(*a*), as will be apparent from comparison of the slot contents of the input signal $\omega t$ with those of the signals Y and W, the signal Y represents result of operation in the same slot of the input signal $\omega t$ one operation period before and the signal W represents result of operation in the same slot of the input signal $\omega t$ two operation periods before.

In FIG. 10, in the selectors 92 and 93, the signals Y and W are respectively selected when the control signal FS3 is "1". Accordingly, when the control signal FS3 is "1", the signals Y and W are added together in the adder 100. When the control signal FS3 is "1", result of operating the output of the adder 100 by the shift circuit 101 and the multiplier 102 is selected by the selector 94 and supplied to the adder 80. In this case, the FM operation output signal Y one operation period before and the FM operation output signal W two operation periods before are added together by the adder 100, the result of addition is divided into half by the ½ shift circuit 101 to obtain a mean value of the two output signals, this mean value is multiplied with the feedback level data FL and the result of the multiplication is added to new phase data $k\omega t$ in the same operation slot. This means that a result of FM operation in a certain operation slot is fed back as a modulating signal in the same operation slot in a next operation period with a result that this operation slot functions as an FM operation channel of a self feedback type. In the foregoing manner, when the connection control signal FS3 is "1", the mode of connection becomes an operation connection of a self feedback type. For preventing occurrence of hunching in the self feedback operation, the adder 100 and the ½ shift circuit 101 are provided for obtaining a mean value of results of operation for two operation periods. When the self feedback operation is not performed, the selector 94 selects the output of the adder 100 through the A input. In this case, the adder 100 functions for producing the modulating signal f(t) by adding results of operation in different operation slots.

A specific example of the operation connection will now be described. In the connection control signal generation circuit 99, the connection control signals FS1–FS3 and the addition control signal VS are generated for the respective operation slots M1, C1, M2 and C2 in accordance with the following Table 1.

TABLE 1

| | TMS | | | |
|---|---|---|---|---|
| CON | M1 | C1 | M2 | C2 |
| 0 | FS3, VS | FS0 | FS0 | FS0 |
| 1 | FS3, VS | — | FS0, FS1 | FS0 |
| 2 | FS3, VS | — | FS0 | FS0, FS2 |
| 3 | FS3, VS | FS0 | — | FS0, FS1 |
| 4 | FS3, VS | — | FS1 | FS1, VS |
| 5 | FS3, VS | FS0 | FS1, VS | FS2, VS |
| 6 | FS3, VS | FS0 | VS | VS |
| 7 | FS3, VS | FS0 | FS1 | VS |
| 4' | FS3, VS | FS3 | FS1 | FS1, VS |

(4' represents a state in which CON is 4 and ABCM is "1")

The operation connection parameter CON selects any of eight connection modes by any of the numbers "0"–"7". In these connection modes, a tone signal is generated by using four operation channels per one tone generation channel. Further, when contents of the parameter CON is 4 and the ABC mode signal ABCM is "1" (designated by "4'"), a special mode of connection is selected. This special mode of connection is employed for the tone generation channel of the chord tone color and in this mode a tone signal is generated by using two operation channels per one tone generation channel. That is, as will be described later, one group consisting of four operation slots M1–C2 is divided into two groups of the slots M1, M2 and C1, C2 and a tone generation channel consisting of two operation slots is established for each of these two groups.

The connection modes corresponding to Table 1 are schematically shown in FIG. 12. In the figure, blocks in which reference characters M1, C1, M2 and C2 are indicated represent the operation slots executed in time division by the FM basic operation circuit 13*a* and a symbol of "+" in a circle represents addition operation executed by the adder 80 or 100. Reference characters $k_1\omega t$, $k_2\omega t$, $k_3\omega t$ and $k_4\omega t$ represent the phase data $K\omega t$ in the respective operation slots M1, C1, M2 and C2. Encircled junctions on the output side represent that the addition is performed in the accumulator 89 in response to the addition control signal VS.

By way of example, an operation when the value of the operation parameter CON is 0 will be described. In this case, the four operation slots M1, C1, M2 and C2 are cascade-connected and the operation for synthesizing a tone signal is performed on the basis of a multiplexing FM operation formula. By the cascade-connection of the operation slots M1 and C1, a simple FM operation formula (generally expressed as $\sin(k_2\omega t+\sin k_1\omega t)$ is executed. By performing the FM operation in the operation slot M2 by using the result of operation of this simple FM operation formula as a modulating signal, a double FM operation generally expressed as $\sin\{k_3\omega t+\sin(k_2\omega t+\sin k_1\omega t)\}$ is performed. By further performing the FM operation in the operation slot C2 by using the result of this double FM operation as a modulating signal, a triple FM operation generally expressed as $\sin[k_4\omega t+\sin\{k_3\omega t+\sin(k_2\omega t+\sin k_1\omega t)\}]$ is performed. In FIG. 12, the operation slot M1 whose output is fed back to its input side represents a self-feedback type operation channel.

The pattern of generation of the control signals FS0–FS3 and VS when this connection of CON=0 is realized is as shown in the above Table 1 and this pattern of generation is also shown by a time chart of FIG. 11(*b*). In FIG. 11(*b*), states of output signals of the corresponding selectors 92, 93 and 94 are shown in the same manner as in FIG. 11(*a*). In the slot M1, the signal VS is turned to "1", the gate 88 thereby is opened and the result of operation obtained in the last slot C2 in the preceding operation period is loaded in the accumulator 89. The result of operation in the slot C2 is delayed by eight slots in the delay circuit 103 so that it is supplied to the gate 88 at the slot M1 of the reference timing (See X in FIG. 11(*a*)). In the slot M1, the signal FS3 is turned to "1" and the signals Y and W are selected in the selectors 92 and 93. Accordingly, as illustrated, when the reference timing is M1 3 , for example, the output of the selector 92 is M1 2 and that of the selector 93 is M1 1 . The selector 94 selects the output of the multiplier 102, i.e., a mean value of results of operation for two preceding operation periods in the same operation slot M1, e.g., when the reference timing is M1 3 , FL×½(M1 2 +M1 1 ). In this manner, the operation slot M1 is used as a self-feedback type operation channel.

In the rest of the operation slots C1, M2 and C2 at CON=0, the signal FS0 is turned to "1". The operation output signal X is selected by the selector 92 and no signal is selected by the selector 93. Further, the output of the adder 100, i.e., the output of the selector 92, is selected by the selector 94 through the A input. As a result, in the slots C1, M2 and C2 of the reference timing, results of operation in the slots C1, M2 and C2 eight slots before (e.g., when the reference timing is C1 2 , M1 2 ) are provided by the selector 94 and supplied to the adder 80 of the basic operation circuit 13*a*. Consequently, results of operation obtained in the preceding operation slot of the same channel is utilized as a modulating signal and the cascade-connection of the operation slots M1, C1, M2 and C2 as illustrated is realized.

For another example, an operation when the value of the operation connection parameter CON is 4 will be described. In this mode of connection, as shown in FIG. 12, the self-feedback type operation slots M1 and M2 are cascade-connected and the operation slots C1 and C2 are cascade-connected and a tone signal for one tone generation channel is generated by synthesizing outputs of the respective cascade-connection. The operation formula therefore is generally described by a two term FM operation formula $\sin(k_3\omega t+\sin k_1\omega t)+\sin(k_4\omega t+\sin k_2\omega t)$. In this case, the phase data $\omega t$ is common and corresponds to the tone pitch of a tone assigned to one tone generation channel.

The pattern of generation of the control signals FS0–FS3 and VS when this connection at CON=4 is realized is as shown in the above Table 1 and this pattern of generation is also expressed by a time chart of FIG. 11(*c*). In this figure, states of the output signals of the corresponding selectors 92, 93 and 94 are also shown. The operation in the operation slot M1 in which the signals FS3 and VS become "1" is the same as the previously described one and the slot M1 thereby becomes a self-feedback type operation channel. In the operation slot C1, none of the control signals FS0–FS3 is produced. The outputs of the selectors 92, 93 and 94 are "0" and no modulating signal f(t) is supplied to the basic operation circuit 13*a*. Accordingly, the FM operation is not substantially performed in the operation slot C1 but a sinusoidal wave signal $\sin k_2\omega t$ is generated.

In the operation slot M2, the signal SF1 is "1" and the signal Y is selected by the selector 93. As will be understood from FIG. 11(*a*), the result of operation in the slot M1 in the same operation period appears as the signal Y in this slot M2. Accordingly, the result of operation of the slot M1 of the same operation period is provided as a modulating signal f(t) of the slot M2 resulting in cascade-connection of the slots M1 and M2. This result of operation by the cascade-connection of the slots M1 and M2 is delayed by eight time slots in the delay circuit 103 and loaded in the accumulator 89 through the gate 88 when the signal VS has been turned to "12 in the slot C2.

In the operation slot C2, the signal FS1 is "1" and the signal Y is selected by the selector 93 in the same manner as was described above. As will be understood from FIG. 11(*a*), result of operation in the slot C1 in the same operation period appears as the signal Y in this slot C2. Accordingly, the result of operation of the slot C1 of the same operation period is provided as a modulating signal f(t) of the slot C2 resulting in cascade-connection of the slots C1 and C2. This result of operation by the cascade-connection of the slots C1 and C2 is delayed by eight time slots by the delay circuit 103 and loaded in the accumulator 89 through the gate 88 when the signal VS has been turned to "1" in next slot M1. In this manner, the mode of connection according to the illustrated two term FM operation is realized.

For another example, an operation when contents of the operation connection parameter CON are 4' (i.e., CON is 4 and ABCM is "1") will be described. As shown in FIG. 12, this mode of connection in appearance is substantially the same as the case of CON=4 except that the operation slot C1 is a self-feedback type operation slot but the tone generation channel consisting of the operation slots M1 and M2 and the tone generation channel consisting of the operation slots C1 and C2 are separate channels and tone signals for two channels are synthesized. More specifically, this mode of connection is one for the tone generation channels CH7–CH10 for the chord tone color in the ABC mode. As will be apparent from FIG. 9, operation slots for the channel CH7 are M1 and M2, more specifically 8 and 24, ones for the channel CH8 are M1 and M2, more specifically 8 and 24, ones for the channel CH9 are C1 and C2, more specifically 15 and 31 and ones for the channel CH10 are C1 and C2, more specifically 16 and 32. In this manner, the system of the slots M1 and M2 and the system of the slots C1 and C2 are separate channels from each other. For this reason, phase data used in the slots M1 and M2 is designated by $\omega_1 t$ and phase data used in the slots C1 and C2 by $\omega_2 t$ to make it clear that they correspond to different tone pitches.

The pattern of generation of the control signals FS0–FS3 and VS is shown in the above Table 1 and this pattern is shown by a time chart of FIG. 11(*d*). In FIG. 11(*d*), states of the output signals of the selectors 92, 93 and 94 are also shown. Difference of this generation pattern from the above described case of CON=4 is that the signal FS3 is "1" in the operation slot C1 whereby the operation slot C1 becomes a self-feedback type operation channel. Since the system consisting of the operation slots C1 and C2 is used as the tone generation channel for the chord tone color, the first operation slot C1 is formed as the self-feedback type operation slot in the same manner as in the tone generation channel for the chord tone color consisting of the operation slots M1 and M2. Other operations are the same as the above described case of CON=4. Thus, in the case of CON=4', the four operation slots M1–C2 which normally correspond to one tone generation channel are divided into two independent tone generation channels consisting of the two operation slots M1 and M2 or C1 and C2 and synthesis of a tone signal according to the simple FM operation is effected in each of the channels. More specifically, a tone signal is synthesized by an FM operation expressed generally by a formula $\sin(k_3\omega_1 t + \sin k_1\omega_1 t)$ in the tone generation channel consisting of the slots M1 and M2 whereas a tone signal is synthesized by an FM operation expressed generally by a formula $\sin(k_4\omega_2 t + \sin k_2\omega_2 t)$ in the tone generation channel consisting of the slots C1 and C2.

The mode of connection shown in FIG. 12 can be realized as accurately as the above described mode of connection by generating the predetermined control signals FS0–FS3 and VS in the pattern shown in Table 1. The mode of connection shown here is only an example and any other mode of connection may be employed. The number of mode of connection is not limited to nine but any desired number of modes may be adopted.

In the above embodiment, the mode for changing the channel setting state is changed depending upon whether the automatic bass/chord performance has been selected or not. The type of automatic performance is not limited to the automatic bass/chord but it may be automatic arpeggio, automatic rhythm or any other automatic performance. Alternatively further, the channel setting state may be changed by an exclusive mode selection means regardless of the automatic performance.

The state of channel setting is not limited to the above described embodiment but it may be determined freely. In the ABC mode, for example, tone generation channels for melody tone color may be composed of two operation slots and the channels CH1–CH5 may be respectively divided by two so that tone generation channels for the melody tone color totalling ten may be established. Conversely, in the ABC mode (i.e., the second mode), the number of the operation slots in one tone generation channel may be increased and the number of the tone generation channels may thereby be decreased. In the above described embodiment, the number of tone generation channels is eight or ten and the number of the operation channels per channel is two or four. These numbers may however be determined at other suitable numbers.

Further, in a case where the number of the operation slots is decreased and the number of the tone generation channels is relatively increased in the second mode, tone signals of the same tone pitch and different tone colors may be generated in the increased channels and tones of the same pitch and different tone colors may thereby be generated. Alternatively, tones of the same tone pitch and same tone color and slightly different in pitch from one another may be generated by utilizing the increased channels. Further, the increased channels may be utilized for generation of effect tones such as drum percussions or a special system tone such as a solo tone (e.g., a tone selected from tones assigned to the melody tone color channels and imparted with a tone color for a solo performance).

The waveshape change control by the waveshape change data WC may be performed either of the operation channels for the carrier and the modulating wave and the manner of changing the waveshape is not limited to the one in the above described embodiment but may be selected from various methods such as disclosed in the copending U.S. patent application Ser. Nos. 659,574 filed on Oct. 10, 1984 and 755,188 filed on July 15, 1985 both assigned to the same assignee with the present application.

The waveshape table used in the FM basic operation circuit is not limited to a sinusoidal wave table but any waveshape table may be used. Further, instead of using the waveshape table, a waveshape signal may be generated by data-converting the phase data or data-processing the phase data by operation.

In actual circuit design, suitable delay circuits are inserted in necessary locations for stabilizing outputs of circuit components such as adders, though such delay circuits are omitted in FIG. 10. In this case, timing of generation of control signals FS0–FS3 and VS should be suitably adjusted.

The tone generation operation executed in the tone generator is not limited to the above described FM operation but may be other operation such as AM operation. The operation channels may be provided in parallel by individual hardware circuits.

As described in the foregoing, according to the present invention, in a case where a limited number of operation channels are divided in using to establish a plurality of tone generation channels for producing a plurality of tones simultaneously, the number of the operation channels can be increased or decreased by suitably changing the number of operation channels used for one tone generation channel. This enables a proper channel setting in accordance with a demand relating to the tone color or the performance style such as a case where a tone signal of a high quality capable of effecting a complex tone color control is to be generated by using a relatively large number of operation channels or a case where a relatively simple tone color control will suffice while the maximum number of tones to be generated simultaneously is to be increased. Moreover, this can be realized by efficiently using the limited number of operation channels without waste so that the device can be produced at a low cost and in a compact design.

What is claimed is:

1. A tone signal generation device having a plurality of tone generation channels, comprising:

tone generation operation means, including a predetermined number of operation channels, for tone signal computation and generating one or more tone signals by performing a specific tone generation operation employing one or more of said operation channels for one tone generation channel, thereby providing said plurality of tone generation channels;

mode selection means for selecting one mode from among a plurality of modes including a first mode and a second mode; and channel establishing means for dividing said operation channels into plural groups in a predetermined manner in accordance with the mode selected by said mode selection means and establishing said tone generation channels as being each constituted by a respective one of the plural groups, the number of said groups being different depending upon the selected mode to change the number of tone generation channels in said tone generation operation means in accordance with the selected mode.

2. A tone signal generation device as defined in claim 1 wherein said channel establishing means comprises tone assignment means for assigning tones to be generated to the tone generation channels established in accordance with the mode selected by said mode selection means and parameter supply means for supplying operation parameters to the respective operation channels in the tone generation channels established according to the selected mode.

3. A tone generation device as defined in claim 1 wherein said mode selection means selects either the first mode or the second mode, and said channel establishing means divides the operation channels into N groups in said first mode to establish N tone generation channels corresponding to the respective N groups and divides the operation channels into M groups in said second mode to establish M tone generation channels corresponding to the respective M groups.

4. A tone signal generation device as defined in claim 3 wherein in said second mode, an operation channel group corresponding to one tone generation channel among the N tone generation channels in said first mode is divided into at least two groups and independent tone generation channels are established by the respective divided groups thereby to establish a total of M ($N<M$) tone generation channels.

5. A tone signal generation device as defined in claim 1 wherein said first mode, the number of the operation channels for each of the tone generation channels is the same and tone signals generated thereby are each generated with a common tone color whereas in said second mode, there is a tone generation channel whose number of operation channels is different from those of another of the tone generation channels whereby the tone signals generated by tone generation channels whose number of operation channels differ from each other have different tone colors from each other.

6. A tone signal generation device as defined in claim 5 wherein a waveshape signal having a particular waveshape and plural phase sections is used for the operation in the operation channels in said tone generation operation means and the tone signal generation device includes waveshape changing means for changing the waveshape of a predetermined waveshape signal in a specific phase section thereof in response to a control signal and, wherein in said second mode, the particular waveshape of the waveshape signal is changed by supplying the control signal to one or more of the operation channels in those tone generation channels in which the number of operation channels is relatively small in comparison to others of the tone generation channels so that harmonic components in the changed waveshape signal used for the respective one or more operation channels are changed.

7. A tone signal generation device as defined in claim 1 wherein said tone generation operation means provides said predetermined number of operation channels in the form of time division time slots and wherein a single basic tone generation operation circuit is used on a time shared basis to compute and generate the one or more tone signals.

8. A tone generation device as defined in claim 1 wherein each of said operation channels in said tone generation operation means includes FM means for performing a basic operation of a tone generation system according to a frequency modulation operation.

9. A tone signal generation device as defined in claim 3 wherein said mode selection means includes an automatic performance selection switch for selecting an automatic performance and the mode selection means selects said first mode when the automatic performance has not been selected and selects said second mode when the automatic performance has been selected by said switch, wherein some of the tone generation channels established in said second mode are used as channels for the automatic performance and the rest of the tone generation channels established in said second mode are used as channels for a manual performance.

10. A plural channel tone generation device comprising:

an operation unit means having a predetermined number of operation units each adapted for performing a specific tone generation operation; and a channel establishing means for assigning each operation unit to one of a plurality of specific groups, the number of operation units in each specific group defining a tone generation channel, wherein the channel establishing means includes an operation unit number changing means for changing the number of operation units in at least one of the specific groups in accordance with a preselected operation mode thereby to change the number of operation units in the corresponding tone generation channel.

* * * * *